US005957208A

United States Patent [19]

Schnatzmeyer

[11] Patent Number: 5,957,208

[45] Date of Patent: Sep. 28, 1999

[54] FLOW CONTROL APPARATUS

[75] Inventor: Mark A. Schnatzmeyer, Lewisville, Tex.

[73] Assignee: Halliburton Energy Services, Inc., Dallas, Tex.

[21] Appl. No.: 08/898,504

[22] Filed: Jul. 21, 1997

[51] Int. Cl.[6] ..... E21B 34/06

[52] U.S. Cl. ..... 166/373; 166/334.4; 166/363

[58] Field of Search ..... 166/364, 373, 166/363, 332.1, 334.1, 334.4

[56] References Cited

U.S. PATENT DOCUMENTS

| | | | |
|---|---|---|---|
| 4,569,370 | 2/1986 | Witt | 137/625.3 |
| 4,848,472 | 7/1989 | Hopper | 166/339 X |
| 4,896,722 | 1/1990 | Upchurch | 166/53 X |
| 5,316,084 | 5/1994 | Murray et al. | 166/332 |
| 5,431,188 | 7/1995 | Cove | 137/625.3 |

OTHER PUBLICATIONS

Master Flow Valve, Inc catalog, undated.

*Primary Examiner*—Roger Schoeppel
*Attorney, Agent, or Firm*—William M. Imwalle; Marlin R. Smith

[57] ABSTRACT

A flow control apparatus and associated methods of using provide enhanced longevity and reliability without requiring complex mechanisms. In a described embodiment, a choke for use within a subterranean well has multiple trim sets which may be individually selected by manipulation of a sleeve relative to an inner tubular cage. In another described embodiment, a single trim set is provided. Additional features include provision of a separate valve to selectively permit or prevent fluid flow through the single or multiple trim sets.

59 Claims, 10 Drawing Sheets

FLOW CONTROL APPARATUS

CROSS-REFERENCE TO RELATED APPLICATIONS

This application is related to a copending application filed on even date herewith, entitled VARIABLE CHOKE FOR USE IN A SUBTERRANEAN WELL, having Brett Bouldin and Napoleon Arizmendi as inventors thereof and an attorney docket number of 970031 U1 USA (application Ser. No. 08/898,567 filed Jul. 21, 1997. The disclosure of the copending application is incorporated herein by this reference.

BACKGROUND OF THE INVENTION

The present invention relates generally to apparatus utilized to control fluid flow in a subterranean well and, in an embodiment described herein, more particularly provides a choke for selectively regulating fluid flow into or out of a tubing string disposed within a well.

In a subsea well completion it is common for the well to be produced without having a rig or production platform on site. In this situation, it is well known that any problems that occur with equipment or other aspects of the completion may require a rig to be moved on site, in order to resolve the problem. Such operations are typically very expensive and should be avoided if possible.

An item of equipment needed, particularly in subsea completions, is a flow control apparatus which is used to throttle or choke fluid flow into a production tubing string. The apparatus would be particularly useful where multiple zones are produced and it is desired to regulate the rate of fluid flow into the tubing string from each zone. Additionally, regulatory authorities may require that rates of production from each zone be reported, necessitating the use of the apparatus or other methods of determining and/or controlling the rate of production from each zone. Safety concerns may also dictate controlling the rate of production from each zone.

Such an item of equipment would also be useful in single zone completions. For example, in a single wellbore producing from a single zone, an operator may determine that it is desirable to reduce the flow rate from the zone into the wellbore to limit damage to the well, reduce water coning and/or enhance ultimate recovery.

Downhole valves, such as sliding side doors, are designed for operation in a fully closed or fully open configuration and, thus, are not useful for variably regulating fluid flow therethrough. Downhole chokes typically are provided with a fixed orifice which cannot be closed. These are placed downhole to limit flow from a certain formation or wellbore. Unfortunately, conventional downhole valves and chokes are also limited in their usefulness because intervention is required to change the fixed orifice or to open or close the valve.

What is needed is a flow control apparatus which is rugged, reliable, and long-lived, so that it may be utilized in completions without requiring frequent service, repair or replacement. To compensate for changing conditions, the apparatus should be adjustable without requiring slickline, wireline or other operations which need a rig for their performance, or which require additional equipment to be installed in the well. The apparatus should be resistant to erosion, even when it is configured between its fully open and closed positions, and should be capable of accurately regulating fluid flow. Additionally, it would be desirable for the apparatus to include features which permit its periodic recalibration, which permit use of redundant trim sets, and which permit selection from among multiple flow port sets in order to regulate in an extended range of flow conditions.

Such a downhole variable choking device would allow an operator to maximize reservoir production into the wellbore. It would be useful in surface, as well as subsea, completions, including any well where it is desired to control fluid flow, such as gas wells, oil wells, and water and chemical injection wells. In sum, in any downhole environment for controlling flow of fluids.

It is accordingly an object of the present invention to provide such a flow control apparatus which permits variable downhole flow choking as well as the ability to shut off fluid flow, and associated methods of controlling fluid flow within a subterranean well.

SUMMARY OF THE INVENTION

In carrying out the principles of the present invention, in accordance with an embodiment thereof, an apparatus is provided which is a choke for use within a subterranean well. The described choke provides ruggedness, simplicity, reliability, longevity, and redundancy in regulating fluid flow into or out of a tubing string within the well.

In broad terms, a choke is provided which includes a tubular inner cage, an outer housing, a sleeve, a trim set formed on the cage and sleeve, and a valve. The sleeve is slidingly disposed about the cage within the housing. Manipulation of the sleeve by a conventional actuator causes the trim set to partially open, fully open, and close as desired. The spring biases the valve toward a position in which fluid flow is not permitted through the trim set.

In another aspect of the present invention, the choke is provided with multiple trim sets, thereby providing selectivity and redundancy in use of the trim sets. The sleeve is displaced relative to the cage by the actuator to use a first trim set, and is further displaced by the actuator to use a second trim set. Such displacement may be axial, circumferential, helical or otherwise.

In yet another aspect of the present invention, a locking mechanism is provided in the choke for maintaining the valve in an open position. In the illustrated embodiment, displacement of the sleeve to open one of the trim sets causes the valve to open and locks the valve in the open position. In this manner, fluid flow through the trim set may be conveniently regulated while the valve permits relatively unobstructed fluid flow through a sidewall portion of the housing.

In still another aspect of the present invention, the multiple trim sets are composed of spaced apart ports and openings formed on the cage and sleeve, respectively. A corresponding pair of the ports and openings may be used by displacing the sleeve relative to the cage a first predetermined distance. Another corresponding pair of the ports and openings may be used by displacing the sleeve relative to the cage a second predetermined distance.

The trim sets utilize a design which both impedes erosion and wear of the choke components, and permits commingling of fluids produced from multiple zones of the well. Such commingling of fluids may be precisely regulated by manipulation of the sleeve with the actuator.

These and other aspects, features, objects, and advantages of the present invention will be more fully appreciated following careful consideration of the detailed description and accompanying drawings set forth hereinbelow.

DETAILED DESCRIPTION

Figure 1A:
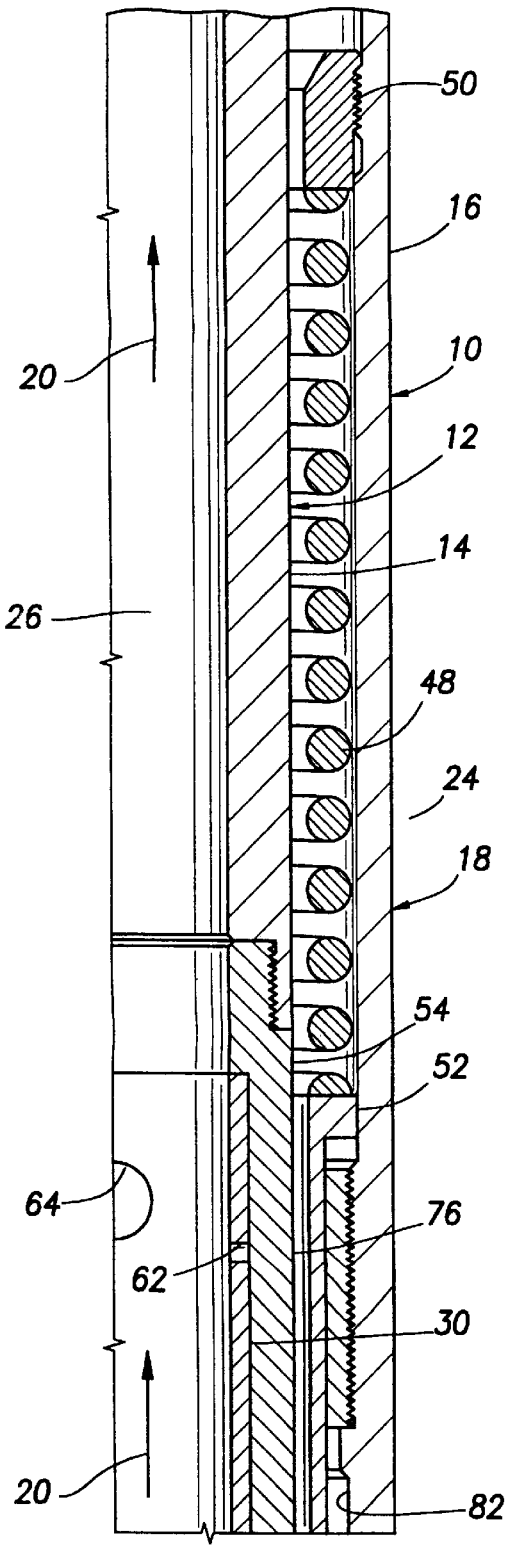
FIGS. 1A–1B are quarter-sectional views of successive axial portions of a choke embodying principles of the present invention, the choke being shown in a configuration in which it is initially run into a subterranean well attached to an actuator and interconnected in a production tubing string.
Figure 1B:
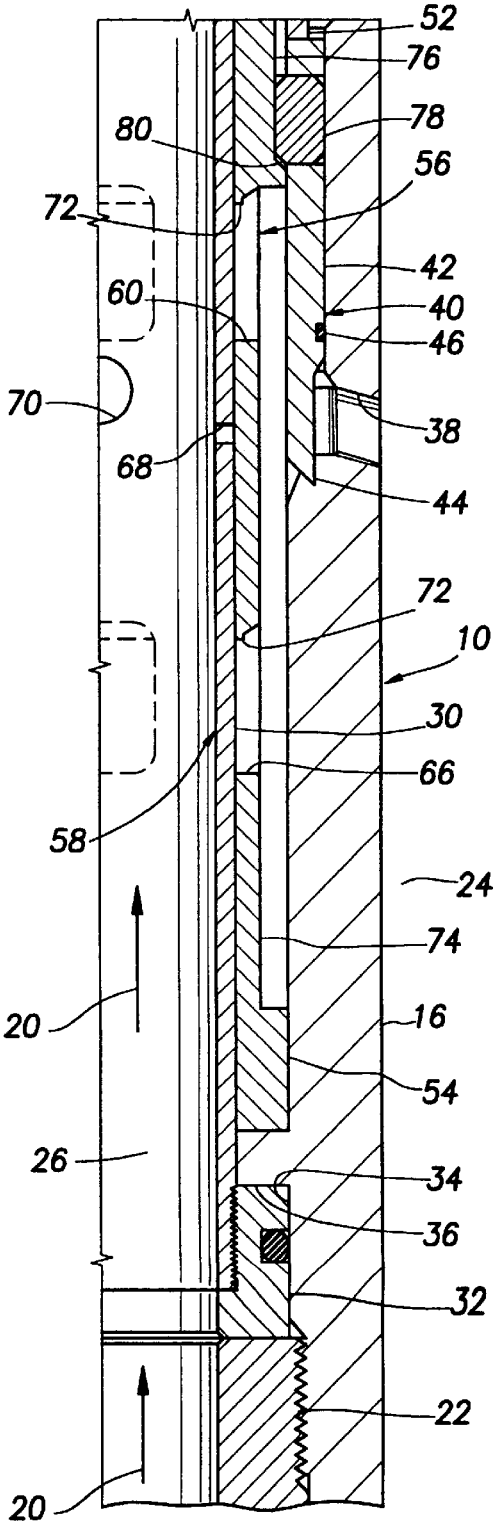

Representatively illustrated in FIGS. 1A–1B is a choke 10 which embodies principles of the present invention. In the following description of the choke 10 and other apparatus and methods described herein, directional terms, such as "above", "below", "upper", "lower", etc., are used for convenience in referring to the accompanying drawings. Although the choke 10 and other apparatus, etc., shown in the accompanying drawings are depicted in successive axial sections, it is to be understood that the sections form a continuous assembly. Additionally, it is to be understood that the various embodiments of the present invention described herein may be utilized in various orientations, such as inclined, inverted, horizontal, vertical, etc., without departing from the principles of the present invention.

The choke 10 is threadedly and sealingly attached to an actuator 12, a lower portion of which is shown in FIG. 1A. In a manner which will be more fully described hereinbelow, the actuator 12 is used to operate the choke 10. The actuator 12 may be hydraulically, electrically, mechanically, magnetically or otherwise controlled without departing from the principles of the present invention. The representatively illustrated actuator 12 may be a SCRAMS ICV hydraulically controlled actuator manufactured by, and available from, PES, Incorporated of The Woodlands, Tex. The actuator 12 may be sealingly and structurally attached to the choke 10 in a manner similar to the manner in which the actuator and choke are attached in the copending application incorporated by reference herein having attorney docket number 970331 U1 USA. The actuator 12 includes an inner tubular mandrel 14 which is axially displaceable relative to the choke 10 by appropriate hydraulic pressure applied to the actuator 12 via control lines (not shown) extending to the earth's surface.

In a method of using the choke 10, the choke and actuator 12 are positioned within a subterranean well as part of a production tubing string 18 extending to the earth's surface. As representatively illustrated in FIGS. 1A–1B, fluid (indicated by arrows 20) may flow axially through the choke 10 and actuator 12, and to the earth's surface via the tubing string 18. The fluid 20 may, for example, be produced from a zone of the well below the choke 10. In that case, an additional portion of the tubing string 18 including a packer (not shown) would be attached in a conventional manner to a lower adaptor 22 of the choke 10 and set in the well in order to isolate the zone below the choke from other zones of the well, such as a zone in fluid communication with an area 24 surrounding the choke.

In a manner more fully described hereinbelow, the choke 10 enables accurate regulation of fluid flow between the external area 24 and an internal axial fluid passage 26 extending through the choke. In another method of using the choke 10, multiple chokes may be installed in the tubing string 18, with each of the chokes corresponding to a respective one of multiple zones intersected by the well, and with the zones being isolated from each other external to the tubing string. Thus, the choke 10 also enables accurate regulation of a rate of fluid flow from each of the multiple zones, with the fluids being commingled in the tubing string 18.

It is to be understood that, although the tubing string 18 is representatively illustrated in the accompanying drawings with fluid 20 entering the lower adaptor 22 and flowing upwardly through the fluid passage 26, the lower adaptor 22 may actually be closed off or otherwise isolated from such fluid flow in a conventional manner, such as by attaching a bull plug thereto, or the fluid 20 may be flowed downwardly through the fluid passage 26, for example, in order to inject the fluid into a formation intersected by the well, without departing from the principles of the present invention. For convenience and clarity of description, the choke 10 and associated tubing string 18 will be described hereinbelow as it may be used in a method of producing fluids from multiple zones of the well, the fluids being commingled within the tubing string, and it being expressly understood that the choke 10 may be used in other methods without departing from the principles of the present invention.

An external housing 16 of the choke 10 is threadedly and sealingly attached to the actuator 12, with the inner mandrel 14 extending downwardly thereinto. The housing 16 may be attached to the actuator 12 in a manner similar to that described in the incorporated copending application. For example, the mandrel 14 may be axially slidingly and sealingly received in an upper connector (not shown) which, in turn, is sealingly and threadedly attached to the housing 16.

To operate the choke 10, the mandrel 14 is axially displaced relative to the housing 16, in order to axially displace an inner axially extending and generally tubular sleeve 54 relative to an inner generally tubular and coaxially disposed cage 30 of the choke. The cage 30 is secured within the housing 16, with the cage being threadedly attached to a stop ring 32, which is sealingly received in an internal bore 34 of the housing. The stop ring 32 is axially retained between an internal shoulder 36 of the housing 16 and the lower adaptor 22, which is threadedly and sealingly attached to the housing. Thus, the cage 30 is prevented from axially displacing relative to the housing 16.

The housing 16 includes a series of circumferentially spaced apart apertures 38, only one of which is visible in FIG. 1B. The apertures 38 are formed through the housing 16 and thereby provide fluid communication between the area 24 external to the choke 10 and the interior of the housing. A valve 40 within the housing 16 includes an axially slidingly disposed sleeve 42 and a circumferential seat 44 formed internally on the housing.

The valve 40 is shown in a closed position in FIG. 1B, with the sleeve 42 sealingly engaging the seat 44. A circumferential seal 46 carried on the sleeve 42 sealingly engages the housing 16. With the valve 40 in its closed position, the seal 46, sleeve 42 and seat 44 cooperate to prevent fluid flow through the apertures 38.

The valve 40 is biased downwardly toward its closed position by a biasing member 48. The biasing member 48 is representatively illustrated as a compression spring, but it is to be understood that other biasing members, such as resilient members, spring washers, etc., may be used without departing from the principles of the present invention. The spring 48 is axially compressed between a stop ring 50 internally threadedly installed within the housing 16 and a generally tubular transfer sleeve 52 installed axially between the spring and the valve sleeve 42. Preferably, such axial compression of the spring 48 provides an initial preload, transferred from the spring to the valve sleeve 42 by the transfer sleeve 52, in order to provide sufficient axial force for the valve sleeve to adequately sealingly engage the seat 44.

As representatively illustrated, the valve sleeve 42 and seat 44 form a metal-to-metal seal, but it is to be understood that other sealing arrangements, such as a sealing arrangement utilizing an elastomeric seal, etc., may be used without departing from the principles of the present invention. The applicant prefers a metal-to-metal seal for its resistance to erosion, environmental conditions, etc. Preferably, the sealing surfaces of the valve sleeve 42 and seat 44 are formed of hardened metal or carbide for erosion resistance, although other materials may be utilized without departing from the principles of the present invention.

The generally tubular trim sleeve 54 is threadedly attached to the actuator mandrel 14 and extends downwardly therefrom. The trim sleeve 54 is coaxially disposed about the cage 30 and is closely slidingly fitted relative thereto. Such close radial fit between the trim sleeve 54 and the cage 30 is used to discourage or substantially obstruct fluid flow radially therebetween. Alternatively, one or more seals may be carried on either or both of the trim sleeve 54 and the cage 30 if it is desired to completely eliminate fluid flow radially between the sleeve and cage.

In an important aspect of the present invention, the trim sleeve 54 and the cage 30 cooperate to form one or more trim sets 56, 58. As used herein, the term "trim set" is used to refer to an element or combination of elements which perform the function of throttling, choking or otherwise regulating fluid flow therethrough. In the illustrated embodiment of the invention, the upper trim set 56 includes a circumferentially spaced apart series of openings 60 formed through a sidewall portion of the trim sleeve 54, and a series of circumferentially spaced apart comparatively small flow ports 62 and a series of circumferentially spaced apart comparatively large flow ports 64 formed through a sidewall portion of the cage 30.

It will be readily appreciated by one of ordinary skill in the art that, with the trim sleeve 54 positioned relative to the cage 30 as representatively illustrated in FIGS. 1A–1B, fluid flow through the trim sets 56, 58 is substantially obstructed. The trim sleeve 54 blocks flow radially through the ports 62, 64, 68, 70, and the cage 30 blocks flow radially through the openings 60, 66. However, note that fluid may flow axially from a port 62, 64, 68, 70 to an opening 60, 66 by flowing radially between the cage and sleeve, but that such flow would be severely restricted due to the close radial fit between the sleeve and cage. In any event, in the configuration of the choke 10 shown in FIGS. 1A–1B, flow through the trim sets 56, 58 is prevented by the valve 40, which is in its closed position as described above.

The openings 60 are axially aligned with the openings 66, and the openings 60, 66 are axially aligned with respective ones of the ports 62, 64, 68, 70. It will be readily appreciated that if the trim sleeve 54 is displaced axially upward relative to the cage 30 by, for example, actuating the actuator 12 to upwardly displace the actuator mandrel 14, eventually one of the openings 66 will be radially aligned with one of the ports 68, thereby permitting unobstructed fluid flow therethrough. Of course, the trim sleeve 54 may be axially positioned to variably obstruct fluid flow through the port 68 by variably aligning one of the openings 66 with one of the ports 68, thereby regulating such fluid flow. Thus, this choking of fluid flow through the ports 68, and other ports as described more fully herein, is infinitely variable.

Preferably, a radially opposing pair of the ports 68 are aligned with a radially opposing pair of the openings 66 when fluid flow is permitted therethrough, in order to limit erosive effects on the cage 30 and trim sleeve 54 caused by such fluid flow. In addition, it is preferred that the openings 66 have an inwardly extending flow deflection lip 72 formed on a peripheral edge thereof, in order to further limit erosive effects. The lip 72 may be similar in some respects to that provided on a commercially available Master Flo Trim manufactured by, and available from, Master Flo of Ontario, Canada.

The foregoing description of the manner of regulating fluid flow through the openings 66 and ports 68 applies substantially similarly to the openings 66 and ports 70, except that, as representatively illustrated in FIGS. 1A–1B, an alternate pair of the openings 66 is utilized to regulate fluid flow through a pair of the ports 70. Also note that, when the trim sleeve 54 is displaced axially upward relative to the cage 30 sufficiently far for the lips 72 to begin crossing the ports 70, the ports 68 will be fully open to unobstructed fluid flow therethrough.

The ports 68 are comparatively smaller than the ports 70 to give an initial, relatively fine, regulated flow therethrough, while the ports 70 are comparatively large to give a broad range of regulated flow therethrough. However, it is to be understood that other configurations of the ports 68, 70 may be utilized without departing from the principles of the present invention, for example, each of the trim sets 56, 58 may include only a single pair of ports instead of two pairs. Additionally, the ports 62, 64 may be identical to the ports 68, 70, respectively, or they may be differently configured. For example, the ports 62, 64 may be larger than the ports 68, 70, in order to provide an even larger range of regulated flow therethrough. Thus, the flow ports 62, 64, 68, 70 may be otherwise dimensioned, otherwise positioned, otherwise dimensioned with respect to each other, and otherwise positioned with respect to each other, without departing from the principles of the present invention.

It will be readily apparent that, if the trim sleeve 54 is further displaced axially upward relative to the cage 30, the openings 66 will no longer be aligned fully or partially with the ports 68, 70. However, continued upward displacement of the trim sleeve 54 will eventually cause the openings 60 to be variably aligned with, and thereby variably regulate fluid flow through, the ports 62, 64 in a manner similar to that described above for the lower trim set 58.

Thus, the upper trim set 56 may be used as a backup or reserve, in case of damage to the lower trim set 58, or vice versa. Alternatively, one of the trim sets 56, 58 may be used to periodically recalibrate the other one of the trim sets in a manner similar to that described in the incorporated copending patent application. Therefore, the trim sets 56, 58 may provide redundancy in the choke 10, or may otherwise increase the functionality of the choke. The provision of the separate valve 40 prevents erosion induced by regulation of flow through the trim sets 56, 58 from affecting the ability of the choke 10 to be closed to fluid flow through the apertures 38.

A series of circumferentially spaced apart and axially extending recesses 74 (only one of which is visible in FIG. 1B) are formed externally on the trim sleeve 54. The recesses 74 permit relatively unobstructed fluid communication between the trim sets 56, 58 and the apertures 38 when the valve 40 is in its open configuration (see FIGS. 2A–2B). A radially reduced external portion 76 of the trim sleeve 54 underlies a series of circumferentially spaced apart lugs 78 (only one of which is visible in FIG. 1B). The lugs 78 are installed radially slidingly through the valve sleeve 42. In a manner that will be more fully described hereinbelow, the lugs 78 will axially contact an inclined shoulder 80 externally formed on the trim sleeve 54 when the trim sleeve is displaced axially upward, thereby causing the lugs and the valve sleeve 42 to displace axially upward with the trim sleeve against the biasing force of the spring 48.

Figure 2A:
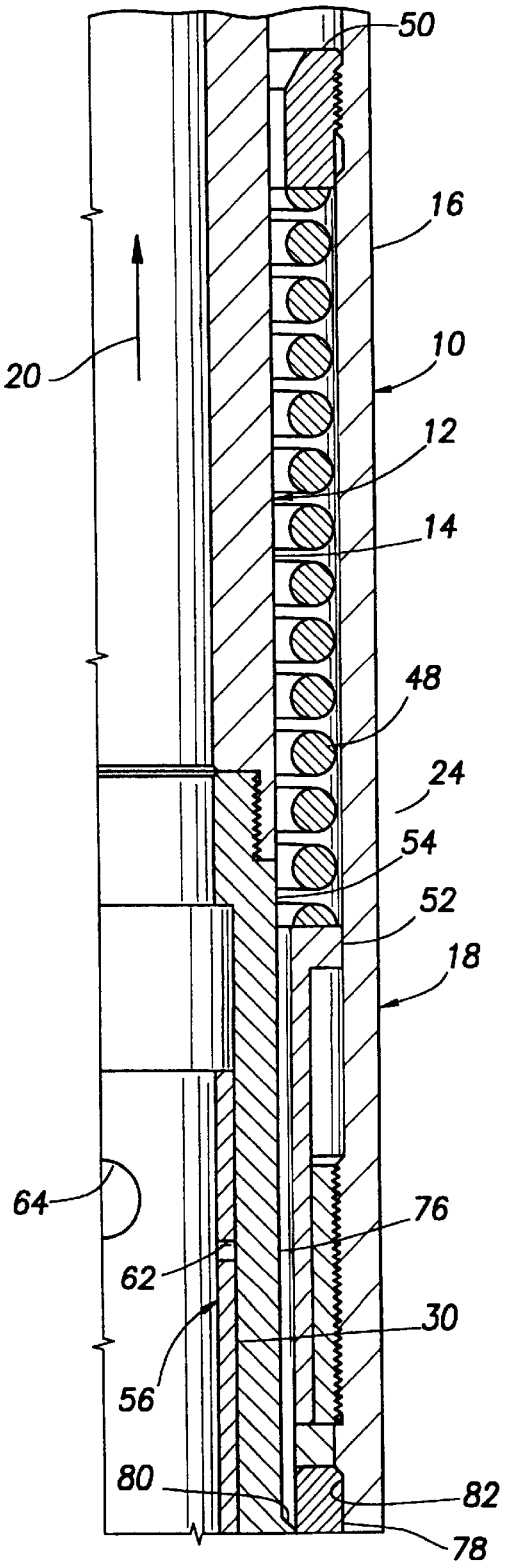
FIGS. 2A–2B are quarter-sectional views of successive axial portions of the choke of FIGS. 1A–1B, the choke being shown in a configuration in which a valve thereof has been locked open.
Figure 2B:
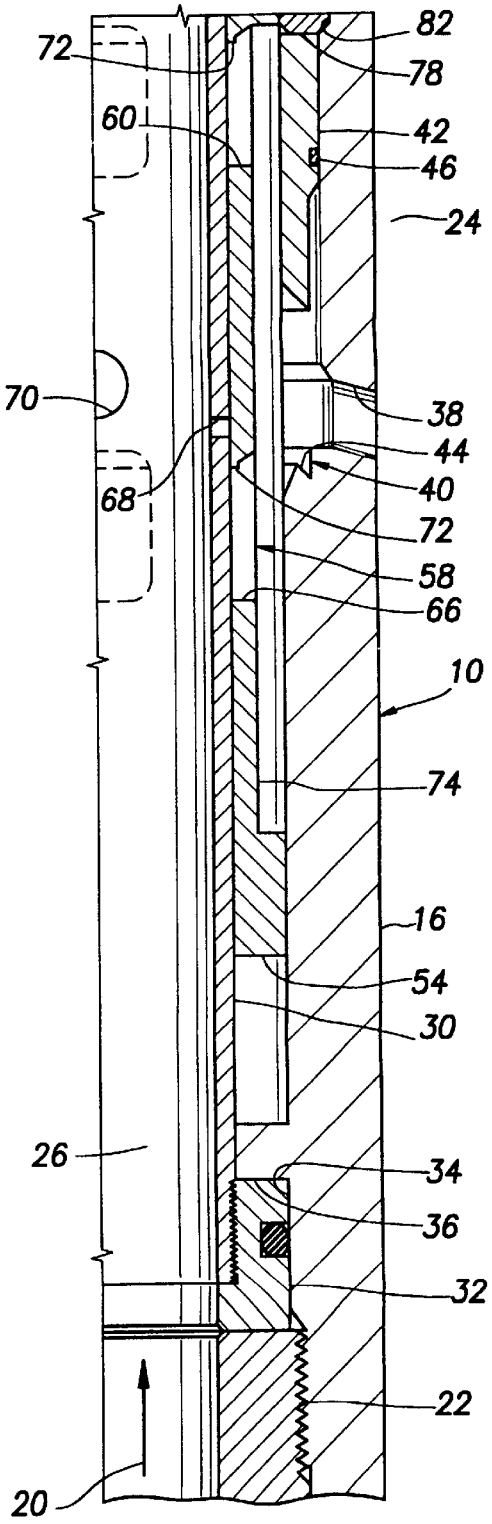

Referring additionally now to FIGS. 2A–2B, the choke 10 is representatively illustrated in a configuration in which the trim sleeve 54 has been axially upwardly displaced somewhat by actuating the actuator 12 to upwardly displace the actuator mandrel 14 relative to the housing 16. The shoulder 80 on the trim sleeve 54 has axially contacted the lugs 78, thereby causing the valve sleeve 42 and lugs to be axially upwardly displaced relative to the housing 16 as well. The lugs 78 have radially outwardly displaced into engagement with a radially enlarged circumferential recess 82 internally formed on the housing 16, due to the contact between the inclined shoulder 80 and the lugs.

With the lugs 78 engaged with the recess 82, the trim sleeve 54 is permitted to further displace axially upward relative to the lugs. Thus, as shown in FIGS. 2A–2B, the trim sleeve 54 is now axially slidingly disposed within the lugs 78. Engagement of the lugs 78 with the recess 82 does, however, prevent axial displacement of the valve sleeve 42, which is now locked in its axial position wherein the valve sleeve does not sealingly contact the seat 44. Therefore, fluid may flow from the external area 24 through the apertures 38 and into the interior of the housing 16. Other locking devices, such as collets, snap rings, etc., may be used in place of the lugs 78 without departing from the principles of the present invention.

Note that, although a very small rate of fluid flow may be permitted from the apertures 38 to the fluid passage 26, such flow is substantially obstructed by the overlaying relationship of the trim sleeve 54 with the cage 30, in that neither of the openings 60, 66 is even partially aligned with any of the ports 62, 64, 68, 70. Thus, FIGS. 2A–2B illustrate the choke 10 in a configuration in which the valve 40 is open, but neither of the trim sets 56, 58 is open.

The sleeve 54 may be displaced to this position by the actuator mandrel 14, by a shifting tool engaged with a shifting profile formed internally on the sleeve or actuator mandrel, or by any other suitable method without departing from the principles of the present invention. In addition, the sleeve 54 may be locked in a desired position by utilizing one or more releasable locking devices. A suitable shifting profile and locking device are described in the incorporated copending patent application having attorney docket number 970331 U1 USA.

Figure 3A:
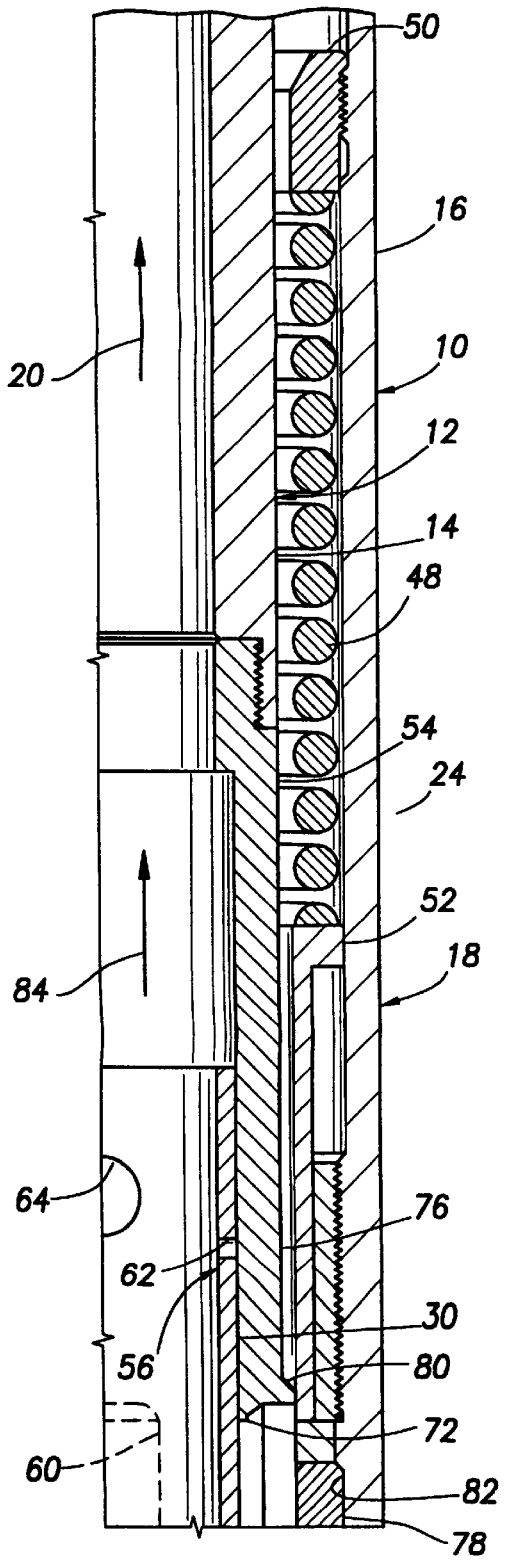
FIGS. 3A–3B are quarter-sectional views of successive axial portions of the choke of FIGS. 1A–1B, the choke being shown in a configuration in which a first trim set thereof has been fully opened.
Figure 3B:
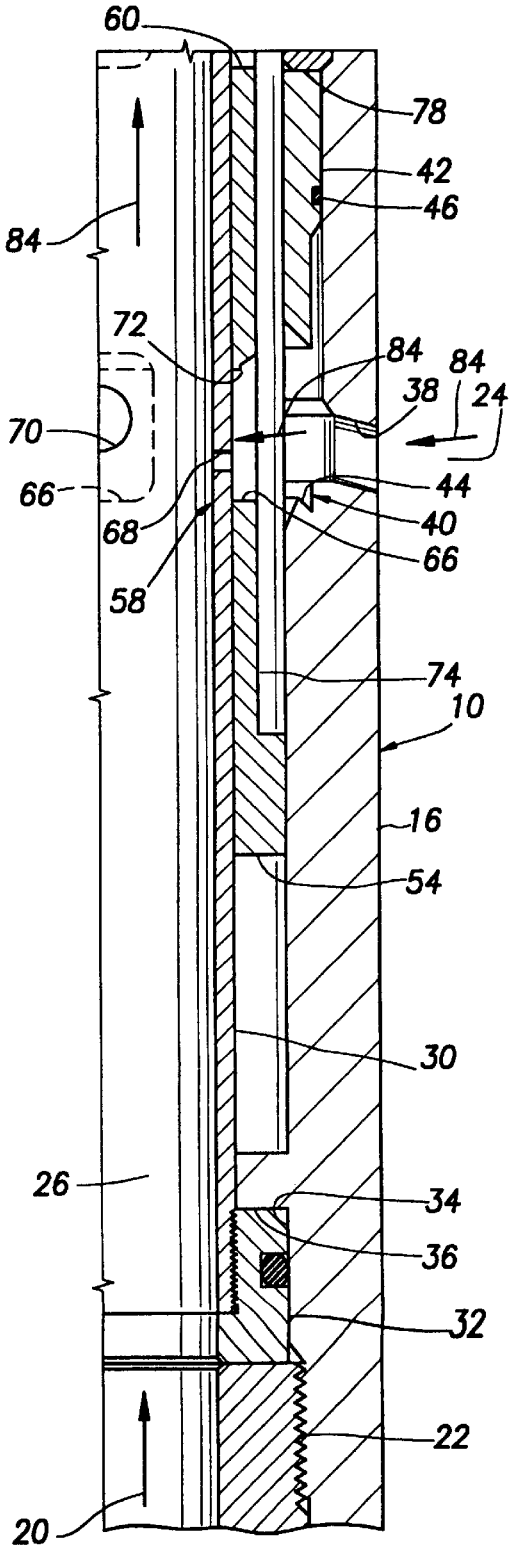

Referring additionally now to FIGS. 3A–3B, the choke 10 is representatively illustrated with the sleeve 54 further axially upwardly displaced relative to the cage 30. Note that the valve 40 remains locked open, with the lugs 78 engaged with the recess 82. The openings 66 are radially aligned with the ports 68, 70, thereby permitting unobstructed flow through the lower trim set 58. Fluid (indicated by arrows 84) may now flow unobstructed from the area 24, inwardly through the apertures 38, into the recesses 74, inwardly through the openings 66, and inwardly through the ports 68, 70 into the fluid passage 26, where it may commingle with the fluid 20.

It will be readily apparent to a person of ordinary skill in the art that, with suitable modification, e.g., interchanging the cage 30 and sleeve 54, the cage 30 may instead be displaced by the mandrel 14 relative to the sleeve 54, to permit variably restricted fluid communication between the area 24 and the fluid passage 26. Alternatively, both the cage 30 and sleeve 54 could be displaced relative to the housing 16 and to each other. No matter the manner in which relative displacement occurs between the cage 30 and sleeve 54, such relative displacement permits variable choking of fluid flow through the flow ports 68, 70 and displacement relative to the housing 16 permits sealing engagement at the seat 44 when desired.

Preferably, the openings 66, and ports 68, 70 are aligned with the apertures 38 in the fully open configuration of the choke 10 and, furthermore, it is preferred that the ports 68, 70, openings 66 and apertures 38 are similarly sized in order to minimize resistance to flow therethrough, reduce friction losses and minimize erosion of the choke 10. However, it is to be clearly understood that it is not necessary in keeping with the principles of the present invention for the ports 68, 70, openings 66 and apertures 38 to be directly aligned with each other, nor for the ports 68, 70, or any combination of them to be identical in size, shape or number with the openings 66 and/or apertures 38. If the ports 68, 70 and openings 66 are not aligned with the apertures 38 in the fully open configuration of the choke 10, then preferably a sufficiently large annular space is provided between the exterior of the sleeve 54 and the interior of the housing 16 or sleeve 42 so that fluid flow therebetween has minimum resistance.

Although FIG. 3B representatively illustrates the cage 30 and sleeve 54 positioned so that the ports 68, 70 and openings 66 are directly aligned with corresponding ones of the apertures 38, it is to be clearly understood that such direct alignment is not necessary in operation of the choke 10. However, to achieve such direct alignment of the ports 68, 70 and openings 66 with the apertures 38, the cage 30, sleeve 54 and/or mandrel 14 may be rotationally secured to the housing 16 in a manner which prevents misalignment between the ports, openings and apertures. For example, a radially outwardly extending projection or key may be provided on the cage 30 and/or sleeve 54 and cooperatively slidingly engaged with a groove or keyway formed internally on the housing 16, etc., to thereby prevent relative circumferential displacement between the cage and housing.

Preferably, the ports 68 are diametrically opposed to each other and the ports 70 are diametrically opposed to each other. It is believed that the diametrically opposite orientation of the ports 68, 70 acts to reduce erosion of the cage 30, in that inwardly directed fluid 84 flowing through one of two diametrically opposing ports will interfere with the fluid flowing inwardly through the other port, thereby causing the fluid velocity to decrease and, accordingly, cause the fluid's kinetic energy to decrease. Thus, the impinging fluid flows in the center of the cage 30 dissipates the fluid energy onto itself and reduces erosion by containing turbulence and throttling wear within the cage.

Additionally, it is preferred that each of the flow port sets 62, 64, 68, 70 includes individual ports of equal size provided in pairs, as shown in the accompanying drawings, or greater numbers, as long as the geometry of the ports is arranged so that impingement results between fluid flowing through the ports, and so that such impingement occurs at or near the center of the cage 30 and away from the ports and other flow controlling elements of the choke 10. As an example of alternate preferred arrangements of the flow port set 70, three ports of equal size and geometry could be provided, spaced around the circumference of the cage 30 at 120 degrees apart from each other, or four ports of equal size and geometry could be provided, spaced around the circumference of the cage at 90 degrees apart from each other, etc.

It is a particular benefit of the embodiment of the invention described herein that portions thereof may erode during normal use, without affecting the ability of the choke 10 to be closed to fluid flow therethrough. For example, the lips 72, the flow port sets 62, 64, 68, 70 and the interior of the cage 30, etc., may erode without damaging the seat 44 or seal 46. Thus, where it is important for safety purposes to ensure the fluid tight sealing integrity of the wellbore, the choke 10 preserves its ability to shut off fluid flow therethrough even where its fluid choking elements have been degraded.

It will be readily appreciated that if the trim sleeve 54 were somewhat downwardly displaced relative to the cage 30, fluid flow through the lower trim set 58 it would be partially obstructed due to partial overlapping of the trim sleeve across the ports 70 and/or ports 68. In this manner, the flow rate of the fluid 84 through the lower trim set 58 may be conveniently regulated. Note that such regulation of the fluid flow through the lower trim set 58 is accomplished without affecting the configuration of the valve 40, the lugs 78 remaining engaged with the recess 82. However, it will also be readily appreciated that if the trim sleeve 54 is displaced axially downward sufficiently far for the radially reduced portion 76 to underlie the lugs 78, the lugs will then be permitted to radially inwardly retract, and the spring 48 will force the valve sleeve 42 axially downward to the closed position of the valve 40.

Fluid flow remains substantially obstructed through the upper trim set 56. Thus, by displacing the trim sleeve 54 relative to the cage 30 as shown in FIGS. 3A–3B, the lower trim set 58 has been selected for fluid flow therethrough, while the upper trim set 56 is substantially unused. In this manner, the lower trim set 58 may be used for an initial period of time, for example, until the lower trim set becomes significantly eroded or otherwise unusable, and then the upper trim set 56 may be selected for use as described more fully hereinbelow. Alternatively, the lower trim set 58 may be used during certain flow conditions, such as an initial completion, and the upper trim set 56 may be used for other flow conditions, for example, where the produced fluid 84 changes over the life of the well.

It is a particular benefit of the present invention that the fluids 20, 84 may be commingled within the fluid passage 26, and the rate of flow of each may be accurately regulated utilizing one or more of the chokes 10 as described hereinabove. For example, another choke, similar to the illustrated choke 10, may be installed below the choke 10 to regulate the rate of flow of the fluid 20, while the choke 10 regulates the rate of flow of the fluid 84. Alternatively, where the choke 10 is used in an injection operation, the choke may be utilized to regulate the rate of fluid flow outward through the apertures 38, and, alone or in combination with additional chokes, may be utilized to accurately regulate fluid flow rates into multiple zones in a well. Of course, the choke 10 may be useful in single zone completions to regulate fluid flow into or out of the zone.

It will be readily apparent to one of ordinary skill in the art that the relative proportions of the fluids 20, 84 produced through the tubing string 18 may be conveniently regulated by selectively permitting greater or smaller fluid flow rates through the upper or lower trim sets 56, 58.

Figure 4A:
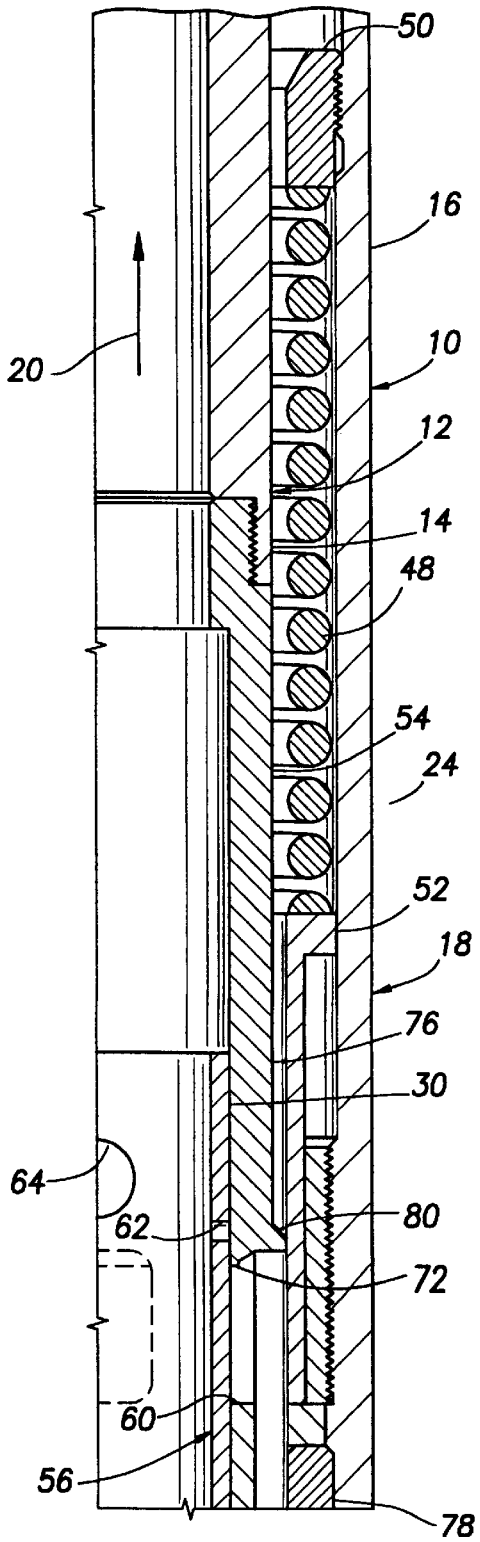
FIGS. 4A–4B are quarter-sectional views of successive axial portions of the choke of FIGS. 1A–1B, the choke being shown in a configuration in which a sleeve thereof is positioned between the first trim set and a second trim set.
Figure 4B:
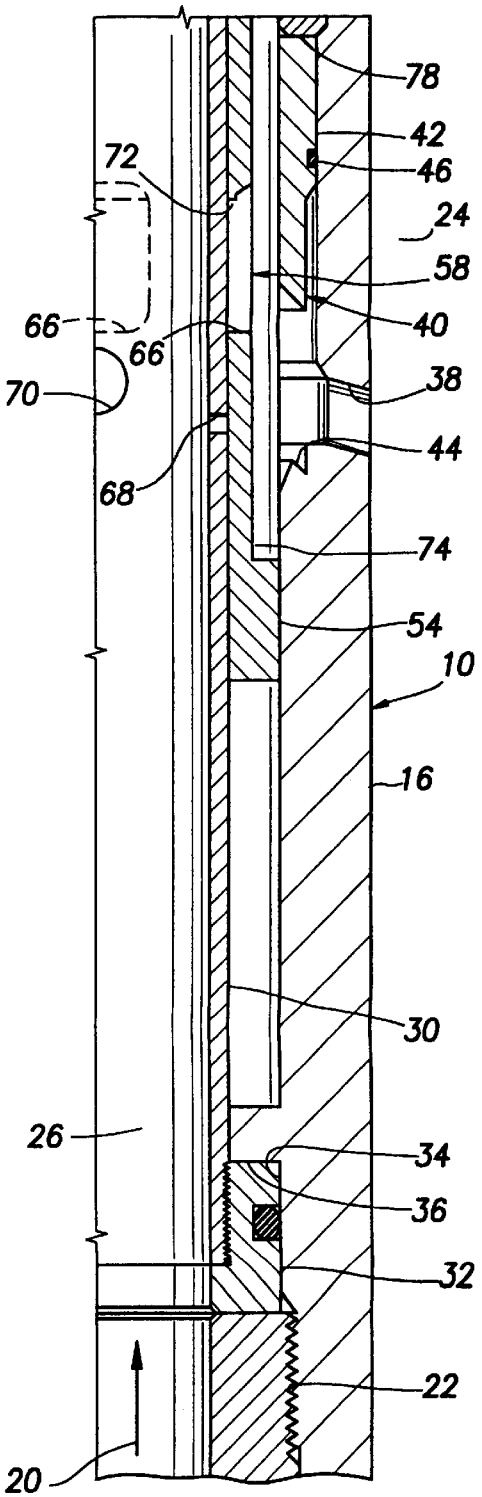

Referring additionally now to FIGS. 4A–4B, the choke 10 is representatively illustrated in an intermediate configuration in which the trim sleeve 54 has been further upwardly displaced relative to the cage 30, and both of the trim sets 56, 58 are substantially closed to fluid flow therethrough. The openings 60, 66 are axially between the ports 62, 64 and the ports 68, 70. In this configuration, the choke 10 is in transition between use of the lower trim set 58 and use of the upper trim set 56. Note that the valve 40 remains open.

Figure 5A:
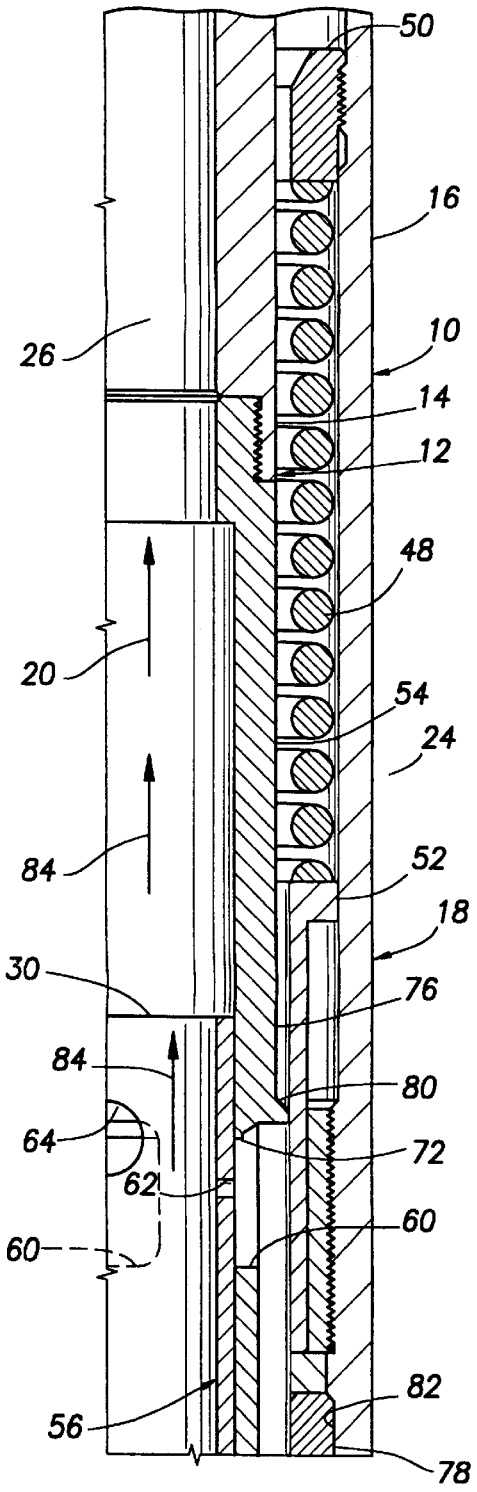
FIGS. 5A–5B are quarter-sectional views of successive axial portions of the choke of FIGS. 1A–1B, the choke being shown in a configuration in which the second trim set is partially open.
Figure 5B:
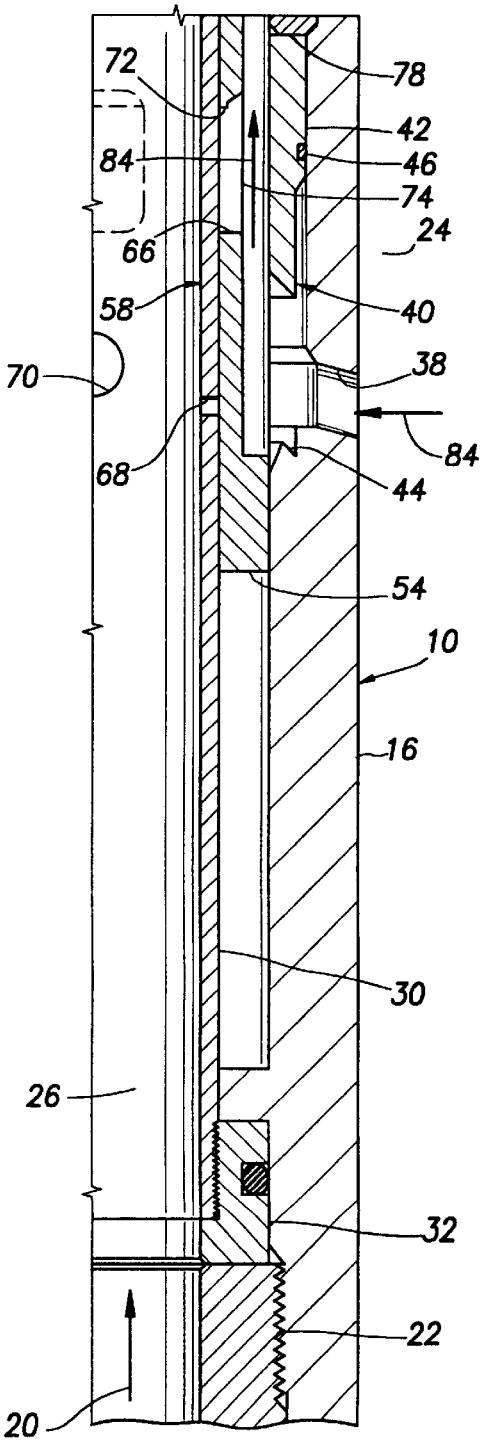

Referring additionally now to FIGS. 5A–5B, the choke 10 is representatively illustrated in a configuration in which the trim sleeve 54 has been further upwardly displaced relative to the cage 30, thereby selecting the upper trim set 56 for fluid flow therethrough. Note that the openings 60 are not fully aligned with the ports 64, and that the ports 64 are, thus, partially obstructed. The lip 72 is deflecting the fluid 84 flowing therethrough, in order to reduce erosion of the trim sleeve 54 and cage 30.

The illustrated embodiment of the invention has been described hereinabove in which the trim sleeve 54 is axially displaced relative to the cage 30 in order to open a trim set or to select from among multiple trim sets 56, 58. It will be readily apparent to one of ordinary skill in the art that the trim sleeve 54 may also be circumferentially displaced relative to the cage 30 in order to accomplish similar results. For example, referring again to FIGS. 3A–3B, if the trim sleeve 54 is rotated about the cage 30, one or both of the ports 68, 70 can be partially or completely obstructed by the trim sleeve, thereby regulating fluid flow through the lower trim set 58. Alternatively, if only one radially opposing pair of the openings 66 is formed through the trim sleeve 54, the ports 68 may be selected for fluid flow therethrough by rotating the trim sleeve to one radial position, and the ports 70 may be selected by rotating the trim sleeve to another radial position. As yet another alternative, instead of the trim sets 56, 58 being axially aligned, their respective openings 60, 66 and ports 62, 64, 68, 70 may be nonaligned, so that one trim set is selected for fluid flow therethrough when the trim sleeve 54 is in one range of radial positions relative to the cage 30, and the other trim set is selected when the trim sleeve is in another range of radial positions. As still another alternative, the trim sets 56, 58 may be helically distributed on the trim sleeve 54 and/or cage 30, so that helical displacement of the trim sleeve relative to the cage accomplishes the selection from among the trim sets. Thus, any manner of displacing the trim sleeve 54 relative to the cage 30 in order to open a trim set or to select from among multiple trim sets 56, 58 may be utilized without departing from the principles of the present invention.

Figure 6:
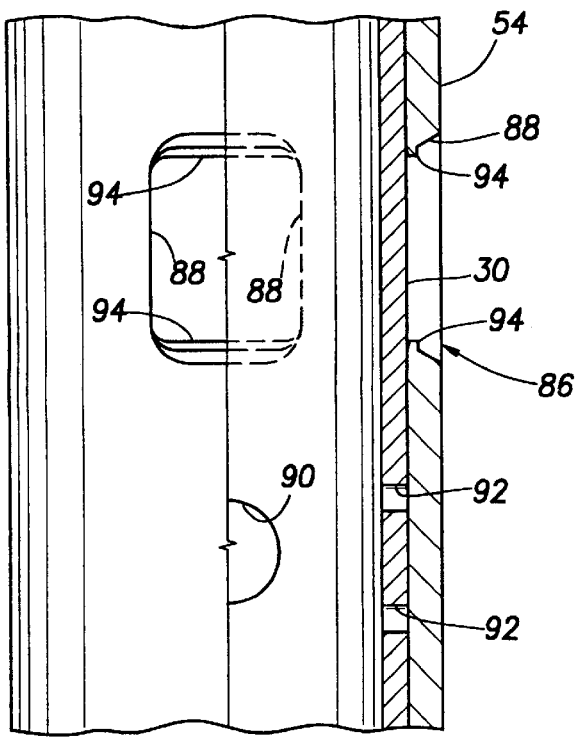
FIG. 6 is a quarter-sectional view of a portion of the choke of FIGS. 1A–1B, showing a first alternate trim configuration.

As indicated hereinabove, the openings 60, 66 and ports 62, 64, 68, 70 may be differently configured, differently arranged, certain ones of them may be eliminated, etc., without departing from the principles of the present invention. Referring additionally now to FIG. 6, an alternate configuration of the trim sleeve 54 and cage 30 is representatively illustrated, apart from the remainder of the choke 10. Only an axial portion of the trim sleeve 54 and cage 30 is shown in FIG. 6, it being understood that the remainder of the trim sleeve and cage, and the remainder of the choke 10 is similar to that shown in FIGS. 1A–5B and described hereinabove.

A trim set 86 formed on the trim sleeve 54 and cage 30 includes a series of circumferentially spaced apart generally rectangular-shaped openings 88 formed through a sidewall portion of the trim sleeve, and a pair of radially opposing comparatively large flow ports 90 (only one of which is partially visible in FIG. 6) and two axially spaced apart pairs of radially opposing comparatively small flow ports 92 (only one of each pair being visible in FIG. 6) formed through a sidewall portion of the cage. Each of the openings 88 has an axially opposing pair of inwardly extending flow deflection lips 94 formed on a peripheral edge thereof.

It will be readily appreciated that if the trim sleeve 54 is axially downwardly displaced relative to the cage 30, eventually the openings 88 will align fully or partially with the ports 90, 92. Initially, a pair of the lower lips 94 will variably traverse the upper pair of the ports 92, thereby providing a relatively fine regulation of fluid flow through the trim set 86. Subsequently, both pairs of lower lips 94 will variably traverse the pair of ports 90, thereby providing a relatively coarse regulation of fluid flow through the trim set 86. If the trim sleeve 54 continues to displace axially downward relative to the cage 30, the pair of lower lips 94 will eventually traverse the lower pair of ports 92, and a pair of the upper lips 94 will begin to traverse the upper pair of ports 92. Further downward displacement of the trim sleeve 54 relative to the cage 30 will cause the upper lips 94 to gradually traverse the ports 90, again providing a coarse regulation, and then the upper lips 94 will traverse the lower pair of ports 92, thereby again providing a relatively fine regulation of fluid flow through the trim set 86.

Thus, the openings 88 and ports 90, 92 may be configured to provide different rates of flow regulation, and those different rates of flow regulation may be achieved by displacement of the trim sleeve 54 in different directions relative to the cage 30. The configuration shown in FIG. 6 may be useful to provide an initial relatively fine regulation, an intermediate relatively coarse regulation and a relatively fine final regulation. In this manner, fine regulation may be provided as the trim set 86 is being opened, coarse regulation may be provided while relatively unobstructed flow is permitted through the trim set, and fine regulation may be provided as the trim set is being closed. Note that if the trim sleeve 54 is to be circumferentially or helically displaced relative to the cage 30 as described hereinabove, the lips 94 may be formed on lateral peripheral edges of the openings 88 and the ports 90, 92 may be positioned circumferentially between the openings.

Figure 7:
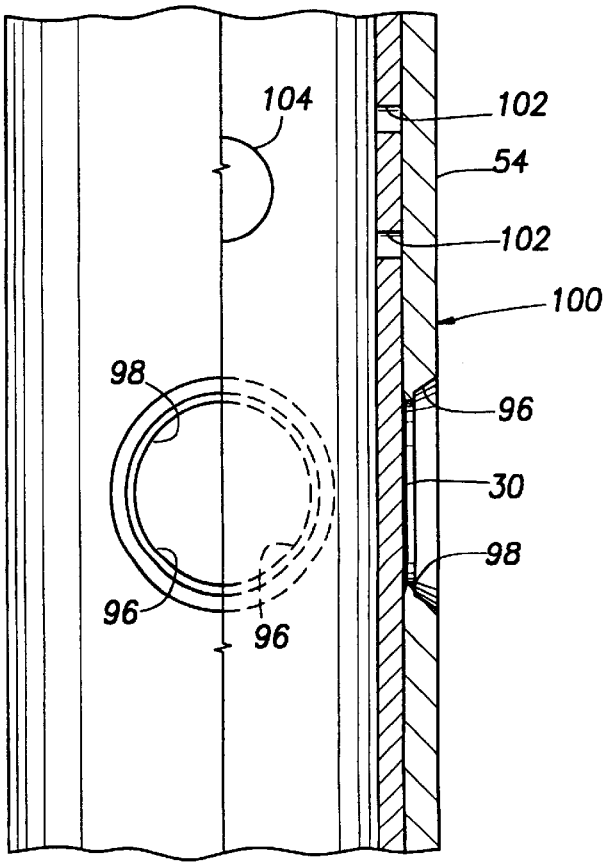
FIG. 7 is a quarter-sectional view of a portion of the choke of FIGS. 1A–1B, showing a second alternate trim configuration

Alternatively, the flow deflection lip may be formed on the entire peripheral edge of an opening. Referring additionally now to FIG. 7, another alternate configuration of the trim sleeve 54 and cage 30 is representatively illustrated, apart from the remainder of the choke 10. Only an axial portion of the trim sleeve 54 and cage 30 is shown in FIG. 7, it being understood that the remainder of the trim sleeve and cage, and the remainder of the choke 10 is similar to that shown in FIGS. 1A–5B and described hereinabove.

Openings 96 are formed through a sidewall portion of the trim sleeve 54. The openings 96 are circumferentially spaced apart and are generally circular. A flow deflection lip 98 extends radially inwardly from the periphery of each of the openings 96. The function of a trim set 100, which includes the openings 96 and a series of ports 102, 104 formed through a sidewall portion of the cage 30, is similar to that of the trim set 86 described above, with some exceptions. The trim sleeve 54 is displaced upward relative to the cage 30, either axially, helically or otherwise, in order to open the trim set 100 for regulated flow therethrough. Additionally, it does not matter which portions of the openings' 96 peripheral edges traverse the ports 102, 104, since the lips 98 are formed on the entire extent of the edges and the edges are circular.

Thus has been described the choke 10 and methods of controlling fluid flow within the well using the choke, which provide redundancy, reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. For example, the actuator mandrel 14 may be releasably attached to the trim sleeve 54, so that, if the actuator 12 becomes inoperative, the trim sleeve 54 may be displaced independently from the mandrel. As another example, the trim sleeve 54 may be displaced circumferentially, rather than axially, in order to selectively open multiple trim sets, such as trim sets positioned radially about the cage 30, rather than being positioned axially relative to the cage. Accordingly, the foregoing detailed description is to be clearly understood as being given by way of illustration and example only, the spirit and scope of the present invention being limited solely by the appended claims.

Figure 8A:
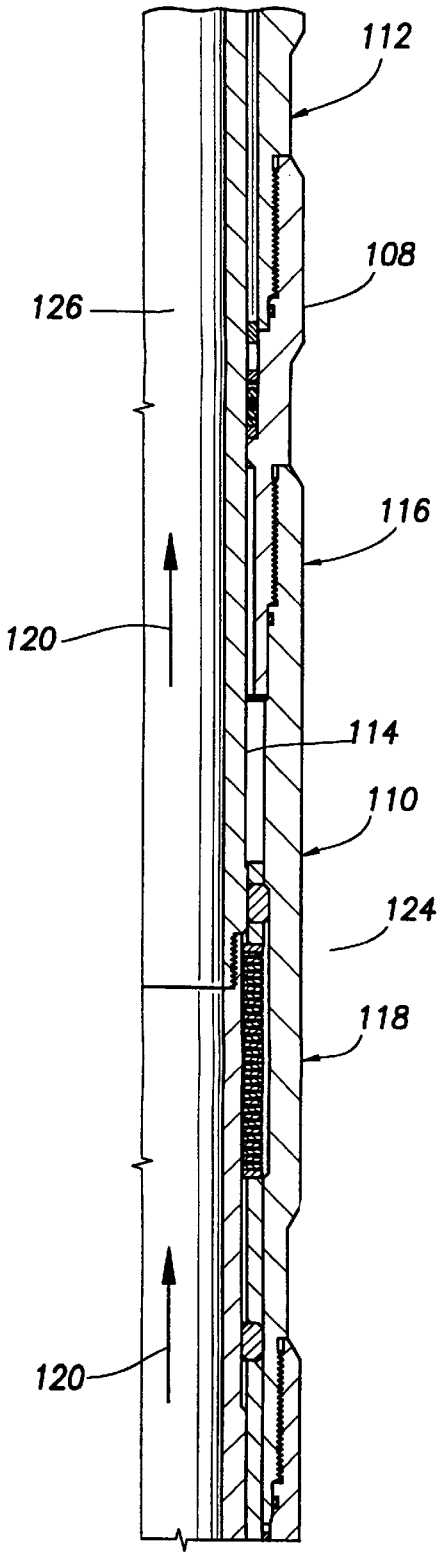
FIGS. 8A–8B are quarter-sectional views of successive axial portions of another choke embodying principles of the present invention, the choke being shown in a configuration in which it is initially run into a subterranean well attached to an actuator and interconnected in a production tubing string.
Figure 8B:
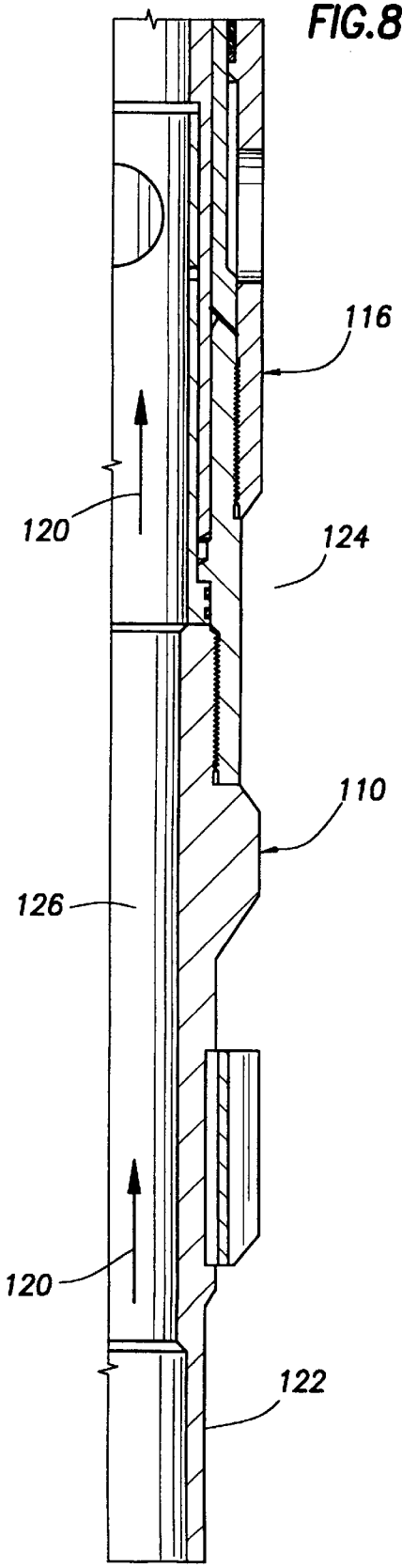

Referring additionally now to FIGS. 8A–8B, another choke 110 embodying principles of the present invention is representatively illustrated in successive axial sections. The choke 110 is threadedly and sealingly attached to an actuator 112, a lower portion of which is shown in FIG. 8A. In a manner which will be more fully described hereinbelow, the actuator 112 is used to operate the choke 110. The actuator 112 may be hydraulically, electrically, mechanically, magnetically or otherwise controlled without departing from the principles of the present invention. The representatively illustrated actuator 112 may be the SCRAMS ICV hydraulically controlled actuator referred to above. The actuator 112 may be sealingly and structurally attached to the choke 110 in a manner similar to the manner in which the actuator and choke are attached in the copending application incorporated by reference herein having attorney docket number 970331 U1 USA. The actuator 112 includes an inner tubular mandrel 114 which is axially displaceable relative to the choke 110 by appropriate hydraulic pressure applied to the actuator 112 via control lines (not shown) extending to the earth's surface.

In a method of using the choke 110, the choke and actuator 112 are positioned within a subterranean well as part of a production tubing string 118 extending to the earth's surface. As representatively illustrated in FIGS. 8A–8B, fluid (indicated by arrows 120) may flow axially through the choke 110 and actuator 112, and to the earth's surface via the tubing string 118. The fluid 120 may, for example, be produced from a zone of the well below the choke 110. In that case, an additional portion of the tubing string 118 including a packer (not shown) may be attached in a conventional manner to a lower adaptor 122 of the choke 110 and set in the well in order to isolate the zone below the choke from other zones of the well, such as a zone in fluid communication with an area 124 surrounding the choke.

In a manner more fully described hereinbelow, the choke 110 enables accurate regulation of fluid flow between the external area 124 and an internal axial fluid passage 126 extending through the choke. In another method of using the choke 110, multiple chokes may be installed in the tubing string 118, with each of the chokes corresponding to a respective one of multiple zones intersected by the well, and with the zones being isolated from each other external to the tubing string. Thus, the choke 110 also enables accurate regulation of a rate of fluid flow from each of the multiple zones, with the fluids being commingled in the tubing string 118.

It is to be understood that, although the tubing string 118 is representatively illustrated in the accompanying drawings with fluid 120 entering the lower adaptor 122 and flowing upwardly through the fluid passage 126, the lower adaptor 122 may actually be closed off or otherwise isolated from such fluid flow in a conventional manner, such as by attaching a bull plug thereto, or the fluid 120 may be flowed downwardly through the fluid passage 126, for example, in order to inject the fluid into a formation intersected by the well, without departing from the principles of the present invention. For convenience and clarity of description, the choke 110 and associated tubing string 118 will be described hereinbelow as it may be used in a method of producing fluids from multiple zones of the well, the fluids being commingled within the tubing string, and it being expressly understood that the choke 110 may be used in other methods without departing from the principles of the present invention.

An external housing assembly 116 of the choke 110 is threadedly and sealingly attached to the actuator 112, with the inner mandrel 114 extending downwardly thereinto. The housing assembly 116 may be attached to the actuator 112 in a manner similar to that described in the incorporated copending application. For example, the mandrel 114 may be axially slidingly and sealingly received in an upper connector 108 which, in turn, is sealingly and threadedly attached to the housing assembly 116.

Figure 9A:
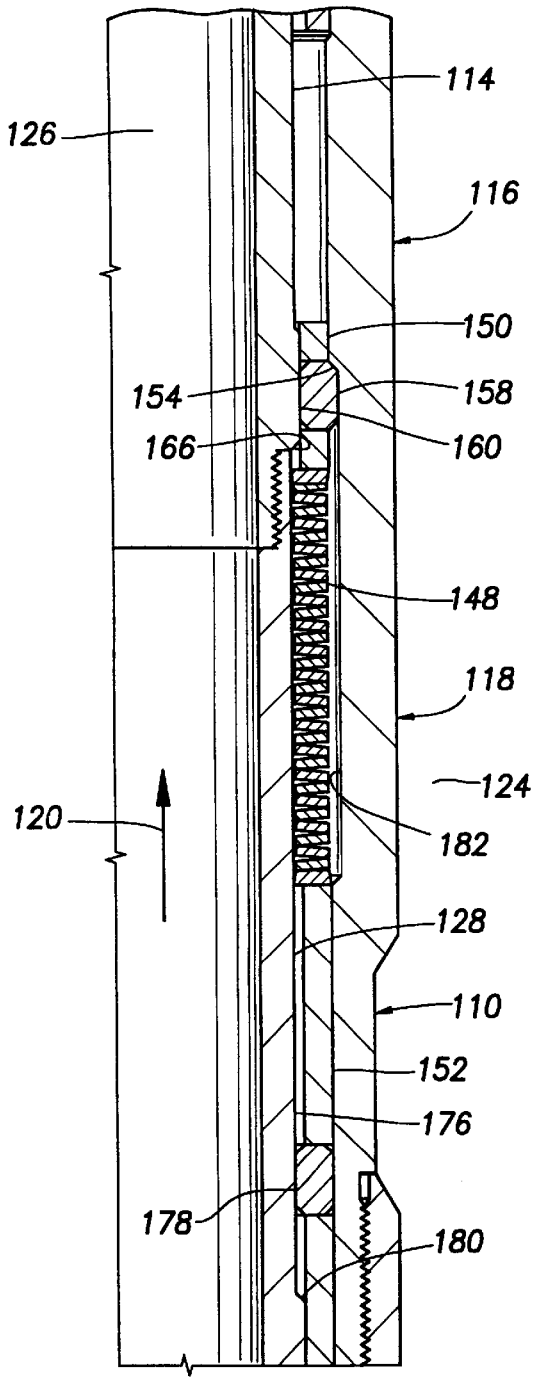
FIGS. 9A–9B are somewhat enlarged quarter-sectional views of successive axial portions of the choke of FIGS. 8A–8B, the choke being shown in a configuration in which a valve portion thereof is biased closed.
Figure 9B:
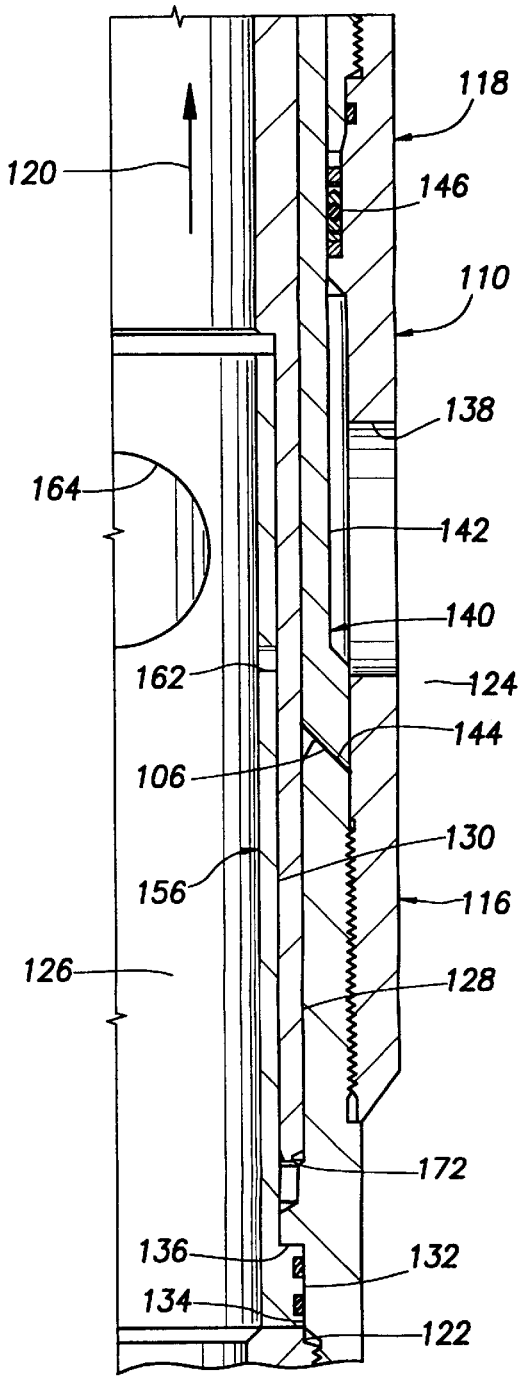

Referring additionally now to FIGS. 9A–9B, the choke 110 is representatively illustrated in a somewhat enlarged scale for enhanced clarity of description. In FIGS. 9A–9B it may be clearly seen that, to operate the choke 110, the mandrel 114 is axially displaced relative to the housing assembly 116, in order to axially displace an inner axially extending and generally tubular trim sleeve 128 relative to an inner generally tubular and coaxially disposed cage 130 of the choke. The cage 130 is secured within the housing assembly 116, with the cage having a radially enlarged portion 132 formed thereon, which is sealingly received in an internal bore 134 of the housing assembly. The radially enlarged portion 132 is axially retained between an internal shoulder 136 of the housing assembly 116 and the lower adaptor 122, which is threadedly and sealingly attached to the housing assembly. Thus, the cage 130 is prevented from axially displacing relative to the housing assembly 116.

The housing assembly 116 includes a series of circumferentially spaced apart apertures 138, only one of which is visible in FIG. 9B. The apertures 138 are formed through the housing assembly 116 and thereby provide fluid communication between the area 124 external to the choke 110 and the interior of the housing assembly. A valve 140 within the housing assembly 116 includes an axially slidingly disposed sleeve 142 and a circumferential seat 144 formed internally on the housing assembly.

The valve 140 is shown in a closed position in FIG. 9B, with the sleeve 142 sealingly engaging the seat 144. A circumferential seal or packing 146 carried internally on the housing assembly 116 sealingly engages the sleeve 142. With the valve 140 in its closed position, the seal 146, sleeve 142 and seat 144 cooperate to prevent fluid flow through the apertures 138.

The valve 140 is biased toward its closed position by a biasing device 148. The biasing device 148 is representatively illustrated as a stack of spring washers or belleville springs, but it is to be understood that other biasing devices, such as resilient members, compression springs, etc., may be used without departing from the principles of the present invention. The device 148 is axially compressed between an annular ring 150 internally installed within the housing assembly 116 and an upper tubular portion 152 of the valve sleeve 142. Preferably, such axial compression of the device 148 provides an initial preload, transferred from the device to the valve sleeve portion 152, in order to provide sufficient axial force for the valve sleeve 142 to adequately sealingly engage the seat 144.

As representatively illustrated, the valve sleeve 142 has a very hard material, such as stellite 106 applied to a lower face thereof for sealing engagement with the seat 144, but it is to be understood that other sealing arrangements, such as a sealing arrangement utilizing an elastomeric or other resilient seal, another type of metal-to-metal seal, etc., may be used without departing from the principles of the present invention. The applicant prefers a metal-to-metal seal for its resistance to erosion, environmental conditions, etc. Preferably, the sealing surfaces of the valve sleeve 142 and seat 144 are formed of hardened metal or carbide, or have a material such as the stellite 106 applied thereto, for erosion resistance, although other materials may be utilized without departing from the principles of the present invention.

In particular, the sleeve 142 and seat 144 may be configured in some respects similar to the spherical flapper sealing arrangement found in the WellStar® and SP-1™ safety valves manufactured by, and available from, Halliburton Energy Services of Duncan, Okla. Regardless of the type and configuration of sealing engagement between the sleeve 142 and seat 144, it is preferred that the effective diameter of such sealing engagement is equal to the diameter at which the seal 146 sealingly engages the sleeve, so that the sleeve is pressure balanced when the valve 140 is in its closed position as shown in FIG. 9B. However, it is to be clearly understood that it is not necessary for the valve sleeve 142 to be pressure balanced in accordance with the principles of the present invention.

The generally tubular trim sleeve 128 is threadedly attached to the actuator mandrel 114 and extends downwardly therefrom. The trim sleeve 128 is coaxially disposed about the cage 130 and is closely slidingly fitted relative thereto. Such close radial fit between the trim sleeve 128 and the cage 130 is used to discourage or substantially obstruct fluid flow radially therebetween. Alternatively, one or more seals may be carried on either or both of the trim sleeve 128 and the cage 130 if it is desired to completely eliminate fluid flow radially between the sleeve and cage.

In an important aspect of the present invention, the trim sleeve 128 and the cage 130 cooperate to form a trim set 156. As used herein, the term "trim set" is used to refer to an element or combination of elements which perform the function of throttling, choking or otherwise regulating fluid flow therethrough. In the illustrated embodiment of the invention, the trim set 156 includes a series of circumferentially spaced apart comparatively small flow ports 162 and a series of circumferentially spaced apart comparatively large flow ports 164 formed through a sidewall portion of the cage 130. Alternatively, or additionally, the trim sleeve 128 may include openings, such as openings 60, 66 of the choke 10 described above, and the choke 110 may include multiple trim sets, without departing from the principles of the present invention.

It will be readily appreciated by one of ordinary skill in the art that, with the trim sleeve 128 positioned relative to the cage 130 as representatively illustrated in FIGS. 9A–9B, fluid flow through the trim set 156 is substantially obstructed. The trim sleeve 128 blocks flow radially through the ports 162, 164. However, note that fluid may flow axially from a port 62, 64 by flowing radially between the cage 130 and sleeve 128, but that such flow would be severely restricted due to the close radial fit between the sleeve and cage. In any event, in the configuration of the choke 110 shown in FIGS. 9A–9B, flow through the trim set 156 is prevented by the valve 140, which is in its closed position as described above.

It will be readily appreciated that if the trim sleeve 128 is displaced axially upward relative to the cage 130 by, for example, actuating the actuator 112 to upwardly displace the actuator mandrel 114, eventually the ports 162, 164 will be uncovered by the sleeve 128, thereby permitting unobstructed fluid flow therethrough. Of course, the trim sleeve 128 may be axially positioned to variably obstruct fluid flow through the ports 162, 164 by variably axially positioning the sleeve 128 relative to the cage 130, thereby regulating such fluid flow. Thus, this choking of fluid flow through the ports 162, 164 as described more fully herein, is infinitely variable.

Preferably, a radially opposing pair of each of the ports 162, 164 is provided, in order to limit erosive effects on the cage 130 and trim sleeve 128 caused by fluid flow therethrough. In addition, it is preferred that the trim sleeve 128 have an outwardly extending flow deflection lip 172 formed on a lower end thereof, in order to further limit erosive effects. The lip 172 may be similar in some respects to that provided on the Master Flo Trim referred to above.

The ports 162 are comparatively smaller than the ports 164 to give an initial, relatively fine, regulated flow therethrough, while the ports 164 are comparatively large to give a broad range of regulated flow therethrough. However, it is to be understood that other configurations of the ports 162, 164 may be utilized without departing from the principles of the present invention, for example, the trim set 156 may include only a single pair of ports instead of two pairs. Additionally, the ports 162, 164 may be identical, or they may be differently configured. Thus, each of the flow ports 162, 164 may be otherwise dimensioned, otherwise positioned, otherwise dimensioned with respect to each other, and otherwise positioned with respect to each other, without departing from the principles of the present invention.

A radially reduced external portion 176 of the trim sleeve 128 underlies a series of circumferentially spaced apart lugs 178 (only one of which is visible in FIG. 9A). The lugs 178 are installed radially slidingly through the upper portion 152 of the valve sleeve 142. In a manner that will be more fully described hereinbelow, the lugs 178 will axially contact an inclined shoulder 180 externally formed on the trim sleeve 128 when the trim sleeve is displaced axially upward, thereby causing the lugs and the valve sleeve 142 to displace axially upward with the trim sleeve.

Figure 10A:
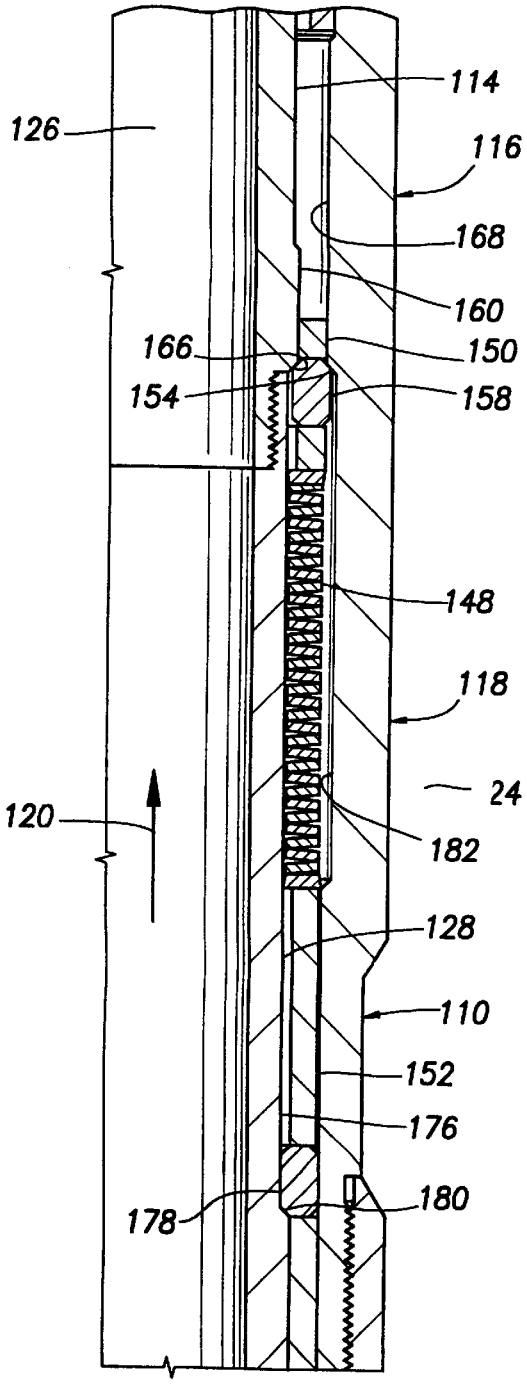
FIGS. 10A–10B are somewhat enlarged quarter-sectional views of successive axial portions of the choke of FIGS. 8A–8B, the choke being shown in a configuration in which a biasing force applied to the valve portion has been removed.
Figure 10B:
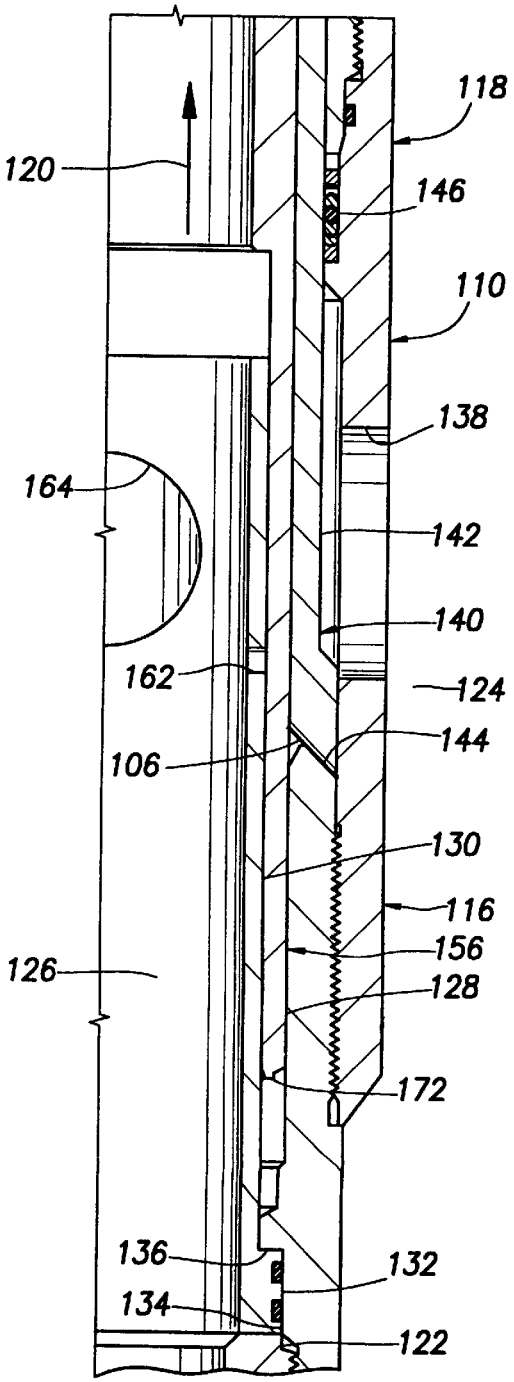

Referring additionally now to FIGS. 10A–10B, the choke 110 is representatively illustrated in a configuration in which the trim sleeve 128 has been axially upwardly displaced somewhat by actuating the actuator 112 to upwardly displace the actuator mandrel 114 relative to the housing assembly 116. The shoulder 180 on the trim sleeve 128 has axially contacted the lugs 178, thereby enabling the valve sleeve 142 and lugs to be axially upwardly displaced relative to the housing assembly 116 as well.

Additionally, a series of circumferentially spaced apart lugs 158 (only one of which is visible in FIG. 10A), which are radially slidingly installed through the ring 150, are now permitted to radially inwardly displace toward the radially reduced portion 176 of the trim sleeve 128. Prior to such upward displacement of the trim sleeve 128, the lugs 158 were radially outwardly retained by a radially enlarged portion 160 formed on the actuator mandrel 114 (see FIG. 9A). The lugs 158 resisted the axial biasing force exerted by the biasing device 148 by axial contact with an inclined shoulder 154 formed internally on the housing assembly 116. However, with the trim sleeve 128 positioned as shown in FIGS. 10A–10B, the lugs 158 now axially contact both the shoulder 154 and an inclined shoulder 166 formed externally on the actuator mandrel 114. It will be readily appreciated that if the trim sleeve 128 is further axially upwardly displaced relative to the housing assembly 116, the lugs 158 will further radially inwardly displace, until they are disposed radially between the radially reduced portion 176 of the trim sleeve and an axial bore 168 formed within the housing assembly 116 (see FIG. 11A). In this manner, the valve sleeve 142 is permitted to displace axially upward with the trim sleeve 128, while the biasing force of the biasing device 148 is resisted by axial contact between the lugs 158 and the shoulder 166, and by axial contact between the lugs 178 and the shoulder 180.

Further axially upward displacement of the trim sleeve 128 relative to the housing assembly 116 will cause the valve 140 to open, since the valve sleeve 142 will no longer sealingly engage the valve seat 144. In that case, fluid may flow from the external area 124 through the apertures 138 and into the interior of the housing assembly 116. Other locking devices may be used to cause the valve sleeve 142 to displace with the trim sleeve 128 and/or to retain the biasing device 148 during displacement of the valve sleeve, for example, collets, snap rings, etc., may be used in place of the lugs 158, 178 without departing from the principles of the present invention.

Note that, although a very small rate of fluid flow may be permitted from the apertures 138 to the fluid passage 126 when the valve 140 has initially opened, but before any of the ports 162, 164 have been partially or fully uncovered by the trim sleeve 128, such flow is substantially obstructed by the overlaying relationship of the trim sleeve with the cage 130.

The trim sleeve 128 may be displaced to the position shown in FIGS. 10A–10B by the actuator mandrel 114, by a shifting tool engaged with a shifting profile formed internally on the sleeve or actuator mandrel, or by any other suitable method without departing from the principles of the present invention. In addition, the sleeve 128 may be locked in a desired position by utilizing one or more releasable locking devices. A suitable shifting profile and locking device are described in the incorporated copending patent application having attorney docket number 970331 U1 USA.

Figure 11A:
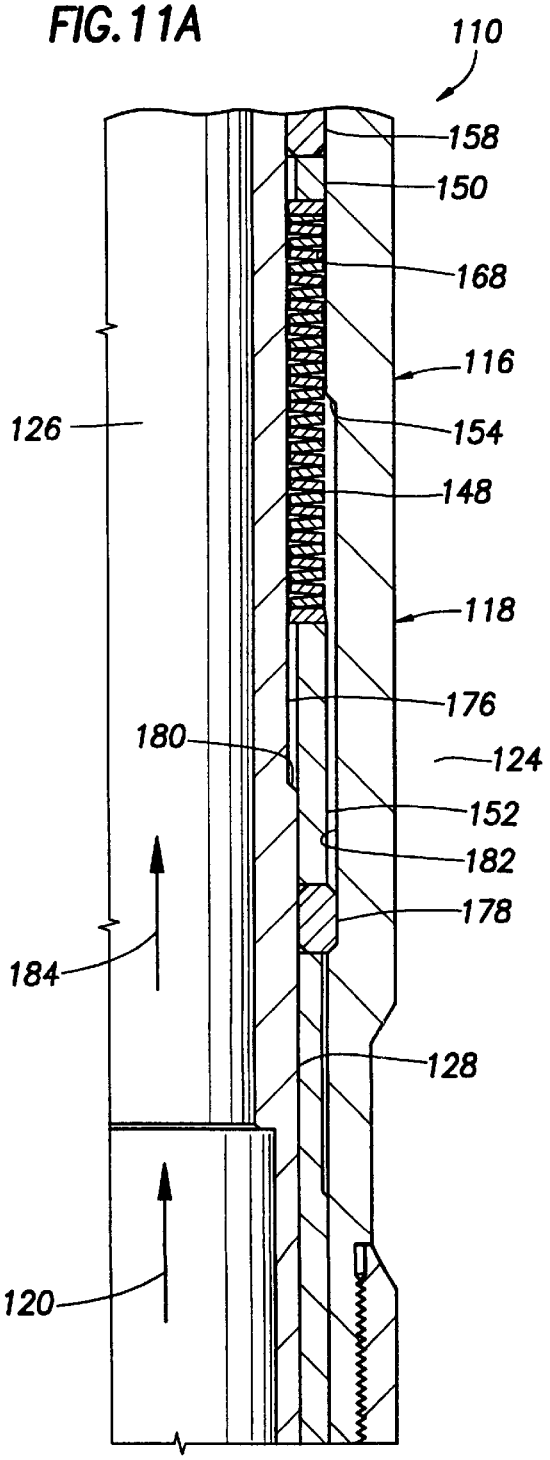
FIGS. 11A–11B are somewhat enlarged quarter-sectional views of successive axial portions of the choke of FIGS. 8A–8B, the choke being shown in a configuration in which the valve portion is locked open and a trim set of the choke is partially opened.
Figure 11B:
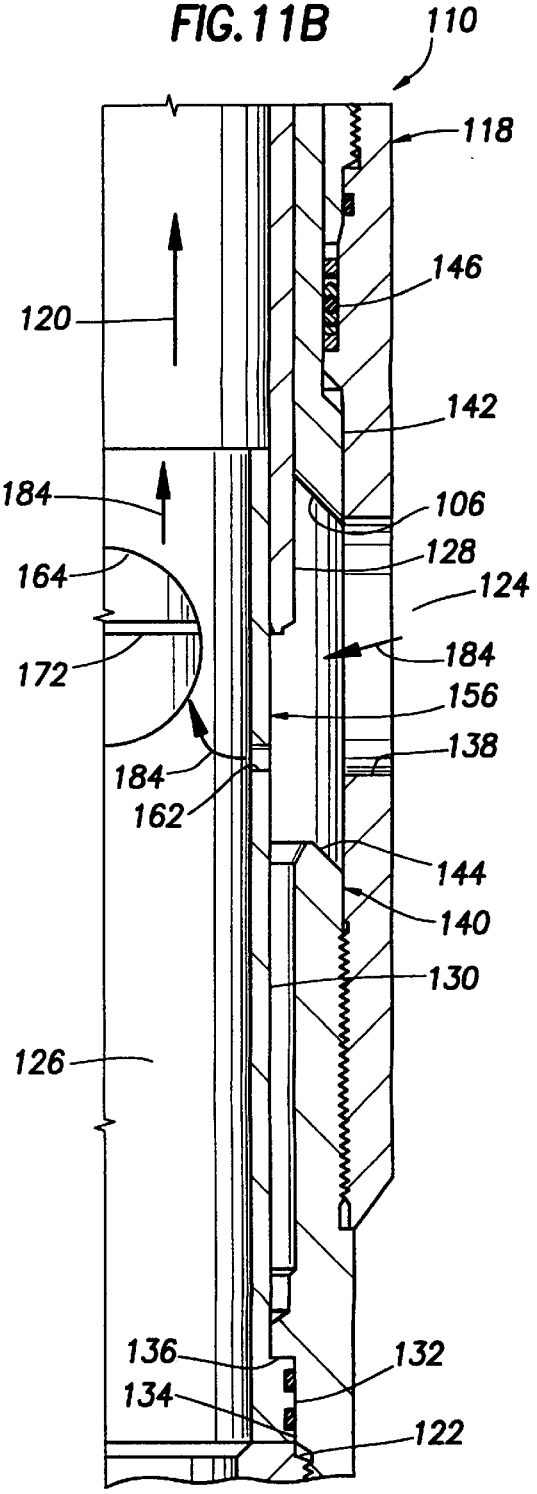

Referring additionally now to FIGS. 11A–11B, the choke 110 is representatively illustrated with the trim sleeve 128 further axially upwardly displaced relative to the cage 130. Note that the valve 140 is locked in a fully open position, with the lugs 178 radially outwardly engaged with a radially enlarged circumferential recess 182 formed internally on the housing assembly 116. With the lugs 178 thus disengaged from the shoulder 180, the valve sleeve 142 no longer displaces upward with the trim sleeve 128. Additionally, note that the lugs 158 have further radially inwardly displaced within the bore 168. Thus, the lugs 158 remain engaged with the shoulder 166 (see FIG. 10A) and further axially upward displacement of the trim sleeve 128 relative to the housing assembly 116 will permit the biasing device 148 to axially expand.

The ports 162 are now fully uncovered by the trim sleeve 128, and the ports 164 are partially uncovered by the trim sleeve. Fluid (indicated by arrows 184) may now flow from the area 124, inwardly through the apertures 138, and inwardly through the ports 162, 164 into the fluid passage 126, where it may commingle with the fluid 120. The trim sleeve 128 may be further axially upwardly displaced to fully uncover the ports 164, and may be variably positioned with respect to the ports 162, 164 to variably regulate fluid flow therethrough.

Preferably, the actuator 112 is of the type which does not displace the trim sleeve 128 upward or downward unless specifically actuated to do so, that is, the trim sleeve is not biased upwardly or downwardly by the mandrel 114 or other member until such bias is specifically desired. In this manner, the choke 110 is not of a "normally closed" or "normally open" type, and failure of the actuator 112 will not affect the position of the trim sleeve 128 relative to the cage 130 or the position of the valve sleeve 142 relative to the seat 144. Note, also, that the biasing device 148 only biases the valve 140 toward its closed position when the trim sleeve 128 has been sufficiently downwardly displaced to substantially prevent fluid flow through the ports 162, 164, and that the biasing device only biases the trim sleeve upwardly after the lugs 178 have retracted into the radially reduced portion 176, after the trim sleeve has been sufficiently downwardly displaced to substantially prevent fluid flow through the ports 162, 164, and before the lugs 158 are radially outwardly supported by the radially enlarged portion 160. However, it is to be clearly understood that other actuators may be utilized with the choke 110 and the trim sleeve 128 may be otherwise biased, for example, to configure the choke as normally closed or normally open, without departing from the principles of the present invention.

It will be appreciated that the choke 110 may be returned to its configuration shown in FIGS. 10A–10B or FIGS. 9A–9B by merely downwardly displacing the trim sleeve 128 relative to the housing assembly 116 utilizing the actuator 112. Such downward displacement of the trim sleeve 128 would permit the lugs 178 to again radially inwardly retract into engagement with the radially reduced portion 176 and to contact the shoulder 180, thereby permitting the valve sleeve 142 to downwardly displace with the trim sleeve. Sufficient downward displacement of the trim sleeve 128 would also permit sealing engagement of the valve sleeve 142 with the seat 144, and such sealing engagement would be enhanced by the biasing force of the biasing device 148.

Note that the biasing device 148 is compressed by downward displacement of the trim sleeve 128 before the lugs 178 radially inwardly displace into the radially reduced portion 176. Additional downward displacement of the trim sleeve 128 will permit the lugs 158 to radially outwardly extend into engagement with the recess 182, with the radially enlarged portion 160 radially outwardly supporting the lugs 158, thereby locking the valve 140 in its closed position.

It will be readily apparent to a person of ordinary skill in the art that, with suitable modification, e.g., interchanging the cage 130 and sleeve 128, the cage may instead be displaced by the mandrel 114 relative to the sleeve, to permit variably restricted fluid communication between the area 124 and the fluid passage 126. Alternatively, both the cage 130 and sleeve 128 could be displaced relative to the housing assembly 116 and to each other. No matter the manner in which relative displacement occurs between the cage 130 and sleeve 128, such relative displacement permits variable choking of fluid flow through the flow ports 162, 164 and displacement relative to the housing assembly 116 permits sealing engagement at the seat 144 when desired.

Preferably, each of the ports 162, 164 is aligned with one of the apertures 138 and, furthermore, it is preferred that the combined flow areas of the ports 162, 164 and the combined flow areas of the apertures 138 are similarly sized in order to minimize resistance to flow therethrough, reduce friction losses and minimize erosion of the choke 110. However, it is to be clearly understood that it is not necessary in keeping with the principles of the present invention for the ports 162, 164 and apertures 138 to be directly aligned with each other, nor for the ports 162, 164, or any combination of them to be identical in size, shape or number with the apertures 138. If the ports 162, 164 are not aligned with the apertures 138 in the fully open configuration of the choke 110, then preferably a sufficiently large annular space is provided between the exterior of the cage 130 and the interior of the housing assembly 116 so that fluid flow therebetween has minimum resistance.

Although FIG. 11B representatively illustrates the cage 130 positioned so that the ports 162, 164 are directly aligned with corresponding ones of the apertures 138 (the depicted port 164 being aligned with an aperture 138 disposed 90 degrees from the depicted aperture 138), it is to be clearly understood that such direct alignment is not necessary in operation of the choke 110. However, to achieve such direct alignment of the ports 162, 164 with the apertures 138, the cage 130, sleeve 128 and/or mandrel 114 may be rotationally secured relative to the housing assembly 116 min a manner which prevents misalignment between the ports and apertures. For example, a radially outwardly extending projection or key may be provided on the cage 130 and/or sleeve 128 and cooperatively slidingly engaged with a groove or keyway formed internally on the housing assembly 116 , etc., to thereby prevent relative circumferential displacement between the cage and housing assembly.

Preferably, the ports 162 are diametrically opposed to each other and the ports 164 are diametrically opposed to each other. It is believed that the diametrically opposite orientation of the ports 162, 164 acts to reduce erosion of the cage 130, in that inwardly directed fluid 184 flowing through one of two diametrically opposing ports will interfere with the fluid flowing inwardly through the other port, thereby causing the fluid velocity to decrease and, accordingly, cause the fluid's kinetic energy to decrease. Thus, the impingement of fluid flows in the center of the cage 130 dissipates the fluid energy onto itself and reduces erosion by containing turbulence and throttling wear within the cage.

Additionally, it is preferred that each of the flow port sets 162, 164 includes individual ports of equal size provided in pairs, or greater numbers, as long as the geometry of the ports is arranged so that impingement results between fluid flowing through the ports, and so that such impingement occurs at or near the center of the cage 130 and away from the ports and other flow controlling elements of the choke 110. As an example of alternate preferred arrangements of the flow port set 164, three ports of equal size and geometry could be provided, spaced around the circumference of the cage 130 at 120 degrees apart from each other, or four ports of equal size and geometry could be provided, spaced around the circumference of the cage at 90 degrees apart from each other, etc.

It is a particular benefit of the embodiment of the invention described herein that portions thereof may erode during normal use, without affecting the ability of the choke 110 to be closed to fluid flow therethrough. For example, the lip 172, the flow port sets 162, 164, and the interior of the cage 130, etc., may erode without is damaging the seat 144, seal 146, or material 106, if any. Thus, where it is important for safety purposes to ensure the fluid tight sealing integrity of the wellbore, the choke 110 preserves its ability to shut off fluid flow therethrough even where its fluid choking elements have been degraded.

It will be readily appreciated that if the trim sleeve 128 is displaced relative to the cage 130, fluid flow through the trim set 156 may be partially or wholly obstructed due to partial or complete overlapping of the trim sleeve across the ports 162 and/or ports 164. In this manner, the flow rate of the fluid 184 through the trim set 156 may be conveniently regulated. Note that such regulation of the fluid flow through the trim set 156 is accomplished without affecting the configuration of the valve 140, the lugs 178 remaining engaged with the recess 182. However, it will also be readily appreciated that if the trim sleeve 128 is displaced axially downward sufficiently far for the radially reduced portion 176 to underlie the lugs 178, the lugs will then be permitted to radially inwardly retract, and the valve sleeve 142 will displace axially downward with the trim sleeve to the closed position of the valve 140.

It is a particular benefit of the present invention that the fluids 120, 184 may be commingled within the fluid passage 126, and the rate of flow of each may be accurately regulated utilizing one or more of the chokes 110 as described hereinabove. For example, another choke, similar to the illustrated choke 110, may be installed below the choke 110 to regulate the rate of flow of the fluid 120, while the choke 110 regulates the rate of flow of the fluid 184. Alternatively, where the choke 110 is used in an injection operation, the choke may be utilized to regulate the rate of fluid flow outward through the apertures 138, and, alone or in combination with additional chokes, may be utilized to accurately regulate fluid flow rates into multiple zones in a well. It will, therefore, be readily apparent to one of ordinary skill in the art that the relative proportions of the fluids 120, 184 produced through the tubing string 118 in the case of a multiple zone completion may be conveniently regulated by selectively permitting greater or smaller fluid flow rates through the trim set 156. Of course, the choke 110 would also be useful in single zone completions to regulate fluid flow into or out of the single zone.

As representatively illustrated in FIG. 11B, the lip 172 is deflecting the fluid 184 flowing through the ports 164, in order to reduce erosion of the trim sleeve 128 and cage 130. It will be readily apparent to one of ordinary skill in the art that the trim sleeve 128 may be provided with otherwise oriented flow deflection lips and may also be circumferentially or otherwise displaced relative to the cage 130 in order to accomplish similar results. For example, if the trim sleeve 128 is provided with openings, such as the openings 60, 66 of the previously described choke 10, and the trim sleeve is rotated about the cage 130, one or both of the ports 162, 164 can be partially or completely obstructed by the trim sleeve, thereby regulating fluid flow through the trim set 156. These and other alternative arrangements of the trim sleeve 128, flow deflection lip 172, ports 162, 164, and any openings formed through the trim sleeve may be utilized without departing from the principles of the present invention. Thus, any manner of displacing the trim sleeve 128 relative to the cage 130 in order to open a trim set 156 or to select from among multiple trim sets may be used in keeping with the principles of the present invention.

Thus has been described the choke 110 and methods of controlling fluid flow within the well using the choke, which provide reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. For example, and as indicated hereinabove, the ports 162, 164 and apertures 138 may be differently configured, differently arranged, certain ones of them may be eliminated, etc., without departing from the principles of the present invention. In addition, the actuator mandrel 114 may be releasably attached to the trim sleeve 128, so that, if the actuator 112 becomes inoperative, the trim sleeve 128 may be displaced independently from the mandrel. As another example, the trim sleeve 128 may be displaced circumferentially, rather than axially, in order to selectively open multiple trim sets, such as trim sets positioned radially about the cage 130, rather than being positioned axially relative to the cage. Accordingly, the foregoing detailed description is to be clearly understood as being given by way of illustration and example only, the spirit and scope of the present invention being limited solely by the appended claims.

What is claimed is:

1. A flow control apparatus operatively positionable within a subterranean well, the apparatus comprising:

a valve;

a first member interconnected to the valve, such that the valve is selectively openable and closeable by displacement of the first member; and a second member having a plurality of ports formed therethrough, at least one of the ports being selectable by the first member for flow of fluid therethrough, fluid flow through the selected one of the ports being regulatable by displacement of the first member relative to the second member.

2. The apparatus according to claim 1, wherein the first member includes a plurality of openings, one of the openings being variably alignable with the selected one of the ports to regulate fluid flow therethrough.

3. The apparatus according to claim 2, wherein another one of the openings is variably alignable with a corresponding other selected one of the ports to regulate fluid flow therethrough.

4. Apparatus operatively positionable within a subterranean well, the apparatus comprising:

a generally tubular member having a flow passage extending generally axially therethrough, and the member further having first and second spaced apart ports formed through a sidewall portion thereof; and a generally tubular first sleeve externally and slidingly disposed about the member, the first sleeve being positionable relative to the member in a selected one of a first position in which the first sleeve substantially prevents fluid flow through the first and second ports, a second position in which fluid flow is permitted through the first port and substantially prevented through the second port, and a third position in which fluid flow is substantially prevented through the first port and fluid flow is permitted through the second port.

5. The apparatus according to claim 4, further comprising a housing having an aperture formed through a sidewall portion thereof, the housing outwardly surrounding the member and first sleeve.

6. The apparatus according to claim 5, further comprising a second sleeve slidingly disposed relative to the housing, the second sleeve selectively permitting and preventing fluid flow through the aperture.

7. The apparatus according to claim 6, wherein the first sleeve is cooperatively engageable with the second sleeve to displace the second sleeve in response to displacement of the first sleeve.

8. The apparatus according to claim 7, wherein the second sleeve is lockable against displacement relative to the housing in response to cooperative engagement between the first and second sleeves.

9. The apparatus according to claim 8, further comprising a biasing member, the biasing member biasing the second sleeve to prevent fluid flow through the aperture.

10. The apparatus according to claim 4, wherein the first sleeve is circumferentially aligned with the tubular member.

11. The apparatus according to claim 4, wherein the first sleeve is axially displaceable between the first, second and third positions.

12. The apparatus according to claim 4, wherein the first sleeve is circumferentially displaceable between the first, second and third positions.

13. The apparatus according to claim 4, wherein the first sleeve is helically displaceable between the first, second and third positions.

14. The apparatus according to claim 4, wherein the first sleeve further includes a plurality of openings formed through a sidewall portion thereof, each of the openings having an inwardly extending lip formed on a peripheral edge thereof.

15. The apparatus according to claim 14, wherein the lips are configured to inhibit erosion of the first sleeve when the first sleeve is in the second and third positions.

16. The apparatus according to claim 14, wherein the lips are configured to inhibit erosion of the tubular member when the first sleeve is in the second and third positions.

17. The apparatus according to claim 4, wherein the first sleeve is further positionable in an infinite number of positions between the first and second positions.

18. The apparatus according to claim 4, wherein the member further has a third port formed through the sidewall portion, and wherein the third port is positioned opposite the first port, whereby when fluid flows inwardly through each of the first and third ports, the fluid flows interfere with each other and inhibit erosion of the tubular member.

19. The apparatus according to claim 4, wherein the first port has a flow area unequal to a flow area of the second port.

20. A choke operatively positionable within a subterranean well and operatively connectable to an actuator disposed within the well, the actuator having an actuator member which is displaceable relative to the choke, the choke comprising:

a generally tubular member having first and second spaced apart flow ports formed through a sidewall portion thereof; and a first sleeve interconnectable to the actuator member and displaceable therewith, the first sleeve having first and second spaced apart openings formed through a sidewall portion thereof, the first sleeve being coaxially disposed relative to the member, and the first sleeve being positionable relative to the member in a selected one of a first position in which the first opening is generally aligned with the first port, a second position in which the second opening is generally aligned with the second port, and a third position in which fluid flow through the first and second ports is substantially blocked by the first sleeve.

21. The choke according to claim 20, wherein the first and second ports are axially aligned, and wherein the first and second openings are axially aligned.

22. The choke according to claim 21, wherein the first sleeve is axially displaceable relative to the member.

23. The choke according to claim 20, further comprising a housing having an aperture formed through a sidewall portion thereof, the member being attached to the housing.

24. The choke according to claim 23, further comprising a second sleeve displaceable by the first sleeve to thereby selectively permit and prevent fluid flow through the aperture.

25. A choke operatively positionable within a subterranean well, the choke comprising:

a generally tubular inner cage having a plurality of spaced apart ports formed through a sidewall portion thereof;

a generally tubular sleeve slidingly disposed relative to the cage, the sleeve being capable of obstructing fluid flow through selected ones of the ports; and a valve, the valve being capable of selectively preventing and permitting fluid flow through the ports.

26. The choke according to claim 25, wherein the valve is operable by sliding displacement of the sleeve.

27. The choke according to claim 25, wherein the sleeve includes a plurality of openings formed through a sidewall portion thereof.

28. The choke according to claim 27, wherein each of the openings is selectively alignable with at least one of the plurality of ports.

29. The choke according to claim 27, wherein each of the openings has an inwardly extending lip formed on a peripheral edge thereof.

30. A method of controlling fluid flow into a tubing string disposed within a subterranean well, the method comprising the steps of:

attaching an actuator to the tubing string;

operatively attaching a choke to the actuator, the choke being capable of regulating fluid flow through a sidewall portion thereof, and the choke including multiple sets of trim and a valve;

actuating the actuator to open the valve;

actuating the actuator to regulate fluid flow through a first trim set; and actuating the actuator to regulate fluid flow through a second trim set.

31. The method according to claim 30, wherein the step of actuating the actuator to regulate fluid flow through the first trim set further comprises substantially preventing fluid flow through the second trim set.

32. The method according to claim 30, wherein the step of actuating the actuator to open the valve further comprises locking the valve in an open position, and further comprising the step of maintaining the valve in the open position during the steps of actuating the actuator to regulate fluid flow through the first trim set and actuating the actuator to regulate fluid flow through the second trim set.

33. The method according to claim 30, wherein the multiple trim sets are formed on coaxially disposed tubular members.

34. The method according to claim 33, wherein the step of actuating the actuator to open the valve is performed by displacing one of the members relative to another of the members.

35. The method according to claim 33, wherein the step of actuating the actuator to regulate fluid flow through the first trim set is performed by displacing one of the members relative to another of the members.

36. A method of controlling fluid flow within a subterranean well, comprising the steps of:

providing an actuator having an actuator member which is displaceable relative to the remainder of the actuator in a selected one of first and second positions;

providing a choke including a first member interconnectable to the actuator member and displaceable therewith, the first member having first and second openings formed therethrough, and a second member having first and second flow ports formed therethrough, the first member being displaceable relative to the second member;

operatively interconnecting the actuator to the choke;

disposing the actuator and choke within the well;

positioning the actuator member in the first position to thereby permit substantially unobstructed fluid flow between the first opening and the first port; and positioning the actuator member in the second position to thereby permit substantially unobstructed fluid flow between the second opening and the second port.

37. The method according to claim 36, wherein the choke is provided including a housing having an aperture formed through a sidewall portion thereof.

38. The method according to claim 37, wherein the choke is provided including a third member capable of selectively permitting and preventing fluid flow through the aperture.

39. The method according to claim 38, wherein the step of positioning the actuator in the first position further comprises displacing the third member to thereby permit fluid flow through the aperture.

40. The method according to claim 39, wherein the step of positioning the actuator in the first position further comprises locking the third member against displacement relative to the housing.

41. A method of controlling fluid flow within a subterranean well, comprising the steps of:

providing a tubular member having a plurality of spaced apart ports formed therethrough;

providing a blocking member for selectively obstructing and permitting substantially unobstructed fluid flow through selected ones of the plurality of ports; and providing a valve for selectively preventing and permitting fluid flow through the selected ones of the plurality of ports.

42. The method according to claim 41, further comprising the step of opening the valve by displacing the blocking member relative to the valve.

43. The method according to claim 42, wherein the step of opening the valve is further performed by displacing the blocking member relative to the tubular member.

44. The method according to claim 41, wherein the blocking member is provided having a plurality of spaced apart openings formed therethrough, and further comprising the step of aligning each of the openings with a respective one of the ports by displacing the blocking member relative to the tubular member.

45. A choke operatively positionable within a subterranean well, the choke comprising:

a generally tubular cage having at least one flow port formed through a sidewall portion thereof;

a generally tubular sleeve slidingly disposed relative to the cage, the sleeve being variably positionable relative to the cage to variably regulate fluid flow through the flow port; and a valve, the valve being capable of selectively preventing and permitting fluid flow through the flow port.

46. The choke according to claim 45, wherein the valve is operable to selectively prevent and permit fluid flow through the port by sliding displacement of the sleeve.

47. The choke according to claim 45, wherein the sleeve includes at least one opening formed through a sidewall portion thereof.

48. The choke according to claim 47, wherein the opening is selectively alignable with the flow port.

49. The choke according to claim 47, wherein the opening has an inwardly extending lip formed on a peripheral edge thereof.

50. The choke according to claim 45, wherein the sleeve has an outwardly extending lip formed on an end thereof.

51. The choke according to claim 45, further comprising a biasing device, the biasing device being configured to bias the valve toward a selected one of preventing and permitting fluid flow through the flow port.

52. The choke according to claim 51, wherein the biasing device is selectively engageable with the sleeve.

53. The choke according to claim 52, wherein the sleeve is capable of varying a biasing force exerted by the biasing device when the sleeve is displaced relative to the cage.

54. The choke according to claim 45, wherein the sleeve cooperatively engages the valve, and locks the valve so that fluid flow is permitted through the flow port, when the sleeve is displaced a predetermined distance relative to tile cage.

55. The choke according to claim 54, wherein the sleeve is configured to displace a portion of the valve against a biasing force exerted by a biasing device on the valve portion when the sleeve is displaced a portion of the predetermined distance relative to the cage.

56. The choke according to claim 45, wherein the sleeve is substantially free of any biasing force applied thereto when the valve prevents fluid flow through the flow port.

57. The choke according to claim 45, wherein the sleeve is substantially free of any biasing force applied thereto when the valve permits fluid flow through the flow port and the sleeve is positioned relative to the cage in a first position.

58. The choke according to claim 57, wherein the sleeve at least partially uncovers the flow port in the first position.

59. The choke according to claim 57, wherein the sleeve completely uncovers the flow port in the first position.

* * * * *